US012601160B2

(12) United States Patent
McCaffrey et al.

(10) Patent No.: US 12,601,160 B2
(45) Date of Patent: Apr. 14, 2026

(54) RETENTION MECHANISM FOR GROUND ENGAGING TOOLS

(71) Applicant: CATERPILLAR INC., Peoria, IL (US)

(72) Inventors: Brandon Hammig McCaffrey, St. Louis, MO (US); Corey Michael Wells, East Peoria, IL (US); William Jay Ulrich, IV, East Peoria, IL (US); Thomas M. Congdon, Dunlap, IL (US); Eric Thomas Sinn, Tremont, IL (US); Douglas Charles Serrurier, Morton, IL (US)

(73) Assignee: CATERPILLAR INC., Peoria, IL (US)

( * ) Notice: Subject to any disclaimer, the term of this patent is extended or adjusted under 35 U.S.C. 154(b) by 402 days.

(21) Appl. No.: 18/356,286

(22) Filed: Jul. 21, 2023

(65) Prior Publication Data

US 2025/0027297 A1 Jan. 23, 2025

(51) Int. Cl.
*E02F 9/28* (2006.01)

(52) U.S. Cl.
CPC ..... *E02F 9/2833* (2013.01); *E02F 9/2825* (2013.01)

(58) Field of Classification Search
CPC ..... E02F 9/28–2875
See application file for complete search history.

(56) References Cited

U.S. PATENT DOCUMENTS 6,052,927 A 4/2000 Pippins
8,938,895 B2 1/2015 Pippins
9,512,599 B2 * 12/2016 Rol Corredor et al. ..... E02F 9/2841
11,142,894 B2 * 10/2021 Wells et al. ..... E02F 9/2833
2004/0118021 A1 * 6/2004 Renski ..... E02F 9/2841 37/456
2004/0237354 A1 * 12/2004 Emrich ..... E02F 9/2841 37/450
2013/0174453 A1 * 7/2013 Cheyne et al. ..... E02F 9/2841 37/456
2017/0328035 A1 11/2017 Bilal et al.
2019/0024349 A1 * 1/2019 Ortiz et al. ..... E02F 9/2841
2020/0378091 A1 * 12/2020 Hyde et al. ..... E02F 9/2858

FOREIGN PATENT DOCUMENTS

RU 2749684 C2 * 6/2021 ..... E02F 9/2825
WO 2012024731 A1 3/2012

OTHER PUBLICATIONS

Velts et al., Russian Patent No. 2749684 C2, Earth Moving Tool Fastening System, machine translation. (Year: 2021).*

* cited by examiner

*Primary Examiner* — Tara Mayo

(57) ABSTRACT

A retention mechanism for connecting a tip to an adapter may have a main retainer, a center pin, and a center pin clip attachable to the center pin. The main retainer may have a retainer body, a non-circular thru hole extending along a central axis, and a male thread around an outer surface of the main retainer. The male thread may engage a female thread in a transverse thru hole in the tip. The center pin may have a profile matching that of the non-circular thru hole of the main retainer. The non-circular thru hole of the main retainer may align with a non-circular blind hole in the adapter when in its fully engaged position. The center pin may be inserted into the non-circular thru hole of the main retainer with a distal end of the center pin positioned in the non-circular blind hole in the adapter.

20 Claims, 19 Drawing Sheets

RETENTION MECHANISM FOR GROUND ENGAGING TOOLS

TECHNICAL FIELD

The present disclosure relates generally to retention mechanisms for ground engaging tools and, more particularly, to retention mechanisms for removably attaching tooth assemblies with replaceable tip and adapter systems to edges of ground engaging implements on various earth-working machines.

BACKGROUND

Earth-working machines, for example, excavators, wheel loaders, hydraulic mining shovels, cable shovels, bucket wheels, bulldozers, and draglines are generally used for digging or ripping into the earth or rock and/or for moving loosened work material from one place to another on a worksite. Such earth-working machines typically include earth-working implements, such as a bucket or a blade, for excavating or moving the work material. These earth-working implements are subjected to extreme wear due to abrasion caused by or impacts of the work material on the implements.

To facilitate the earth-moving process and to prolong the useful life of the implement, a plurality of tip assemblies may be placed along a base edge of a working implement (e.g., bucket or blade) and may be attached to a surface of the implement. The tip assemblies project forward from the base edge and form a first point of contact with and penetration into the work material. Thus the abrasion and impacts caused by the work material tend to cause wear on the tip assemblies instead of on the base edge, reducing the amount of wear on the base edge. With this arrangement, the tip assemblies may be subjected to the wear and/or breakage caused by repetitive engagement with the work material. Periodically, the tip assemblies must be replaced, but the implement may remain useable through multiple cycles of replacement tip assemblies. Depending on the variety of uses and work materials for the equipment, it may also be desirable to change the type and/or shape of the tip assemblies to most effectively utilize the implement.

Installation and replacement of the tip assemblies may be facilitated by providing the tip assemblies with a variety of retention systems. For example, an adapter may be attached to the base edge of the implement. The adapter may be welded, bolted, or otherwise secured to the base edge. A ground engaging tip may be attached to the adapter using a retention mechanism that facilitates installation and/or removal of the tip to/from the adapter.

One example of a retention mechanism is disclosed in U.S. Pat. No. 6,052,927 to Pippins issued Apr. 25, 2000 ("the '927 patent"). The disclosed retention mechanism includes a tooth assembly having an adapter fitted with a removable tooth. The tooth is mounted on an adapter nose of the adapter by means of a pair of tooth bolts, each extending through a bolt opening in opposite side walls of the tooth and threaded in an internally-threaded insert seated in an insert cavity extending into opposite sides of the adapter nose. Each internally-threaded insert includes an internally-threaded insert bore, extending through a tapered, rounded insert body which terminates in an insert shoulder having a straight shoulder edge. The respective oppositely-disposed insert cavities are also tapered and shaped to define a cavity shoulder, which engages the insert shoulder, and an internal peripheral surface, which engages the insert body. Accordingly, the insert cavities of the adapter nose removably receive the internally-threaded inserts and prevent the inserts from rotating when the tooth bolts are inserted through the bolt openings in the opposite side walls of the tooth, threadedly engaged with the internally-threaded inserts, and tightened.

Many problems and/or disadvantages still exist with known retention mechanisms such as the retention mechanism of the Pippins. For example, the system described in Pippins may require complex machining operations or difficult to cast parts, resulting in a number of expensive parts that may be difficult to uninstall for replacement of worn parts after a machine using the retention mechanism has been operating under severe environmental conditions, and may lack the desired strength characteristics for heavy earth moving applications. Various embodiments of the present disclosure may solve one or more of the problems and/or disadvantages.

SUMMARY

In one aspect, the present disclosure is directed to retention mechanism for connecting a ground engaging tip to an adapter. The retention mechanism may include a main retainer, a center pin, and a center pin clip attachable to the center pin. The main retainer may include a retainer body extending from a retainer proximal end to a retainer distal end. The main retainer may include a non-circular thru hole extending along a central axis of the main retainer. The main retainer may also include a male thread on an outer surface of the main retainer. The male thread may be configured to threadedly engage a female thread in a transverse thru hole in the tip. The center pin may include a non-circular outer profile that matches the profile of the non-circular thru hole of the main retainer. The non-circular thru hole of the main retainer may be configured to be aligned with a non-circular blind hole in the adapter when the main retainer is in its fully engaged position. The center pin may be configured to be inserted into the non-circular thru hole of the main retainer with a distal end of the center pin positioned in the non-circular blind hole in the adapter.

In another aspect, this disclosure is directed to a tip assembly. The tip assembly may include an adapter configured to be fixed to a work implement. The tip assembly may include a tip configured to be mounted on the adapter. The tip assembly may also include a retention mechanism. The adapter may include a retainer opening extending into a nose of the adapter in a direction transverse to a longitudinal axis of the adapter. The adapter may also include a blind hole with a non-circular cross-section extending further into the nose from an inner bottom surface of the retainer opening. The tip may include a nose cavity configured to receive the nose of the adapter. The tip may also include a transverse thru hole extending through a lateral side wall of the tip transverse to the longitudinal axis. The transverse thru hole may be in communication with the nose cavity and may include a female thread. The retention mechanism may include a main retainer, a center pin, and a center pin clip attachable to the center pin. The main retainer may include a retainer body extending from a retainer proximal end to a retainer distal end. The main retainer may also include a non-circular thru hole extending along a central axis of the main retainer. Further, the main retainer may include a male thread on an outer surface of the main retainer, the male thread being configured to threadedly engage the female thread in a transverse thru hole. The center pin may include a non-circular outer profile that matches the profile of the non-circular thru hole of the main retainer. The non-circular thru hole of the main retainer may be configured to be aligned with a non-circular blind hole in the adapter when the main retainer is in its fully engaged position. The center pin may be configured to be inserted into the non-circular thru hole of the main retainer with a distal end of the center pin positioned in the non-circular blind hole in the adapter.

In another aspect this disclosure is directed to a tip assembly, The tip assembly may include a tip configured to be mounted on an adapter and a retention mechanism. The tip may include a nose cavity configured to receive a nose of the adapter. The tip may also include a transverse thru hole extending through a lateral side wall of the tip transverse to the longitudinal axis. The transverse thru hole may be in communication with the nose cavity. The retention mechanism may include a main retainer, a center pin, and a center pin clip. The main retainer may include a retainer body extending from a retainer proximal end to a retainer distal end. The main retainer may also include a non-circular thru hole extending along a central axis of the main retainer. Further, the main retainer may include a detent on an inner wall of the thru hole adjacent the retainer proximal end. The main retainer may also include a threaded outer surface of the retainer body configured to engage with a thread in the transverse thru hole. The center pin may include a non-circular outer profile that matches a profile of the non-circular thru hole of the main retainer. The center pin clip may be attachable to the center pin and may include a protrusion on an outer surface of the center pin clip. When the main retainer is in its fully engaged position, the non-circular thru hole of the main retainer may be configured to be aligned with a blind hole in the adapter, the center pin may be configured to be inserted into the non-circular thru hole of the main retainer with a distal end of the center pin positioned in the blind hole in the adapter, and the protrusion on the center pin clip is configured to engage with the detent.

DETAILED DESCRIPTION

Figure 1:
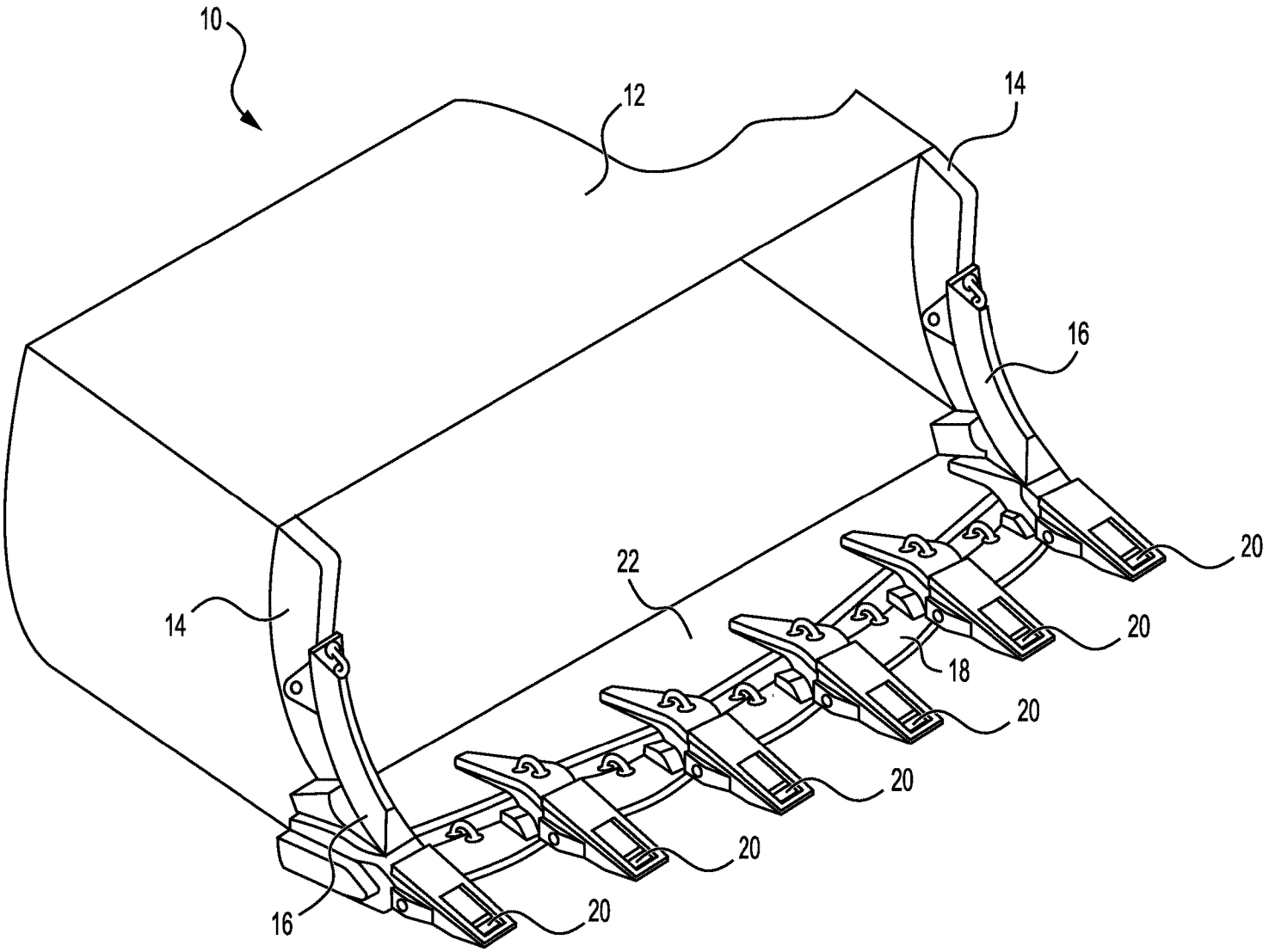
FIG. 1 is a pictorial illustration of an exemplary working implement.

FIG. 1 illustrates an exemplary work implement 10 for a bottom wearing application, such as a loader machine application. As illustrated in the exemplary embodiment of FIG. 1, the work implement 10 may be a bucket 12, which may include a pair of oppositely-disposed arms 14 on which corresponding corner guards 16 may be mounted. Bucket 12 may also include a plurality of ground-engaging tip assemblies 20 mounted along a base edge 22 with edge protector assemblies 18 interposed between the tip assemblies 20 and secured along the base edge 22 of the bucket 12.

Figure 2:
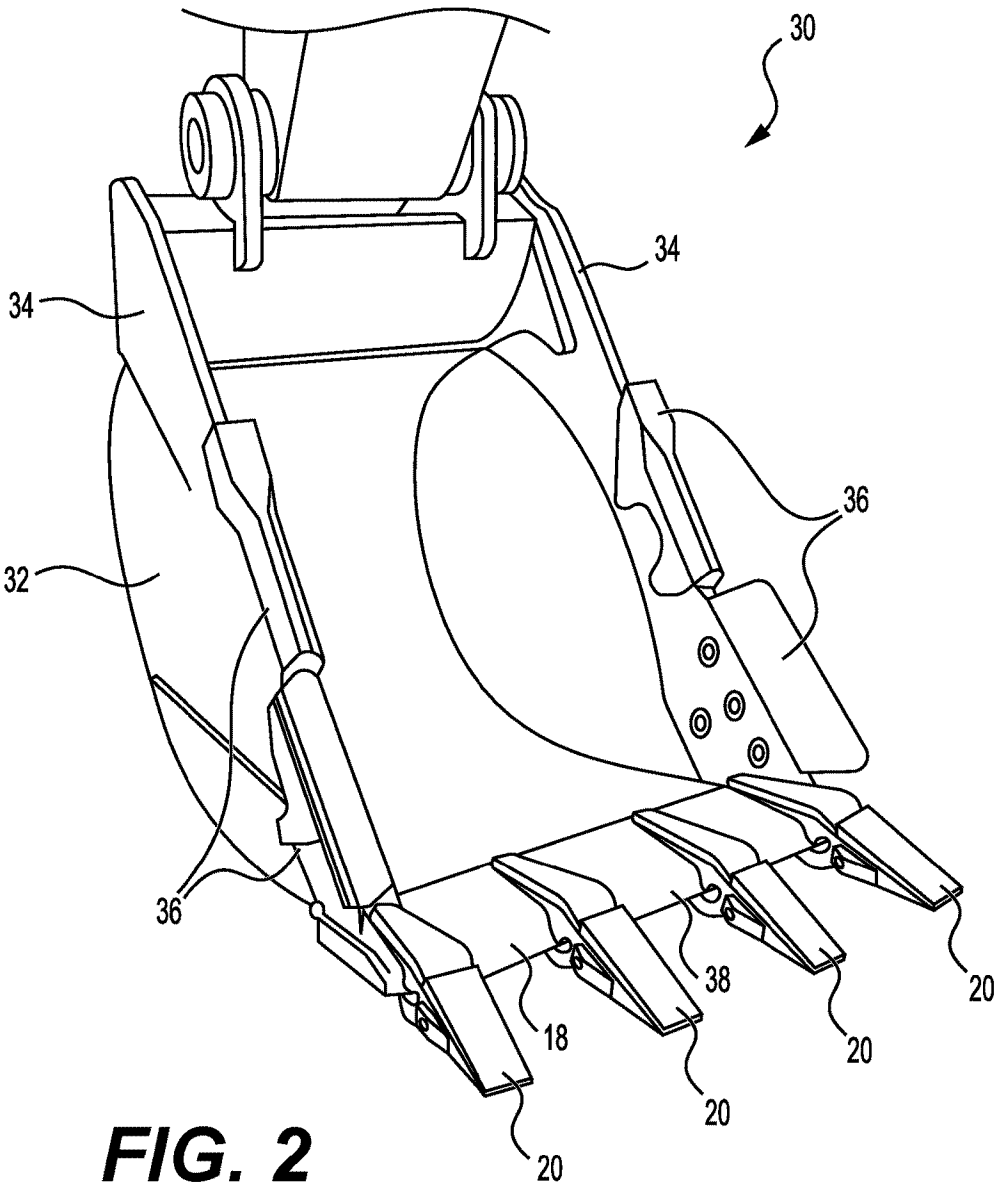
FIG. 2 is a pictorial illustration of another exemplary working implement.

FIG. 2 illustrates another exemplary work implement 30 for a top-wearing application, such as an excavator application. As illustrated in the exemplary embodiment of FIG. 2, work implement 30 may take the form of an excavator bucket 32. Bucket 32 may include a pair of oppositely-disposed arms 34 on which corresponding corner guards 36 may be mounted. Bucket 32 may include a plurality of tip assemblies 20 mounted along a base edge 38. Work implement 30 may also include one or more edge protector assemblies 18 interposed between tip assemblies 20, with edge protector assemblies 18 and tip assemblies 20 being secured along base edge 38 of the bucket 32. Although exemplary work implements 10 and 30 have been illustrated in FIGS. 1 and 2, it is contemplated that work implements of other shapes and sizes may also include tip assemblies 20 attached to respective base edges of the work implements.

Various embodiments of tip assemblies may be implemented in bottom wearing or top wearing applications. Although a particular tip assembly or component embodiment may be described with respect to a particular bottom wearing or top wearing application, it is to be understood that the tip assemblies are not limited to a particular type of application and may be interchangeable between implements of various applications. Further, although bottom wearing and top wearing applications have been described above, it is to be understood that the disclosed embodiments are not limited to the described applications. Rather, the disclosed embodiments may be used on implements used in other types of applications (e.g., front wearing applications, end-wearing applications, or any other applications for which such implements may be used).

Figure 3:
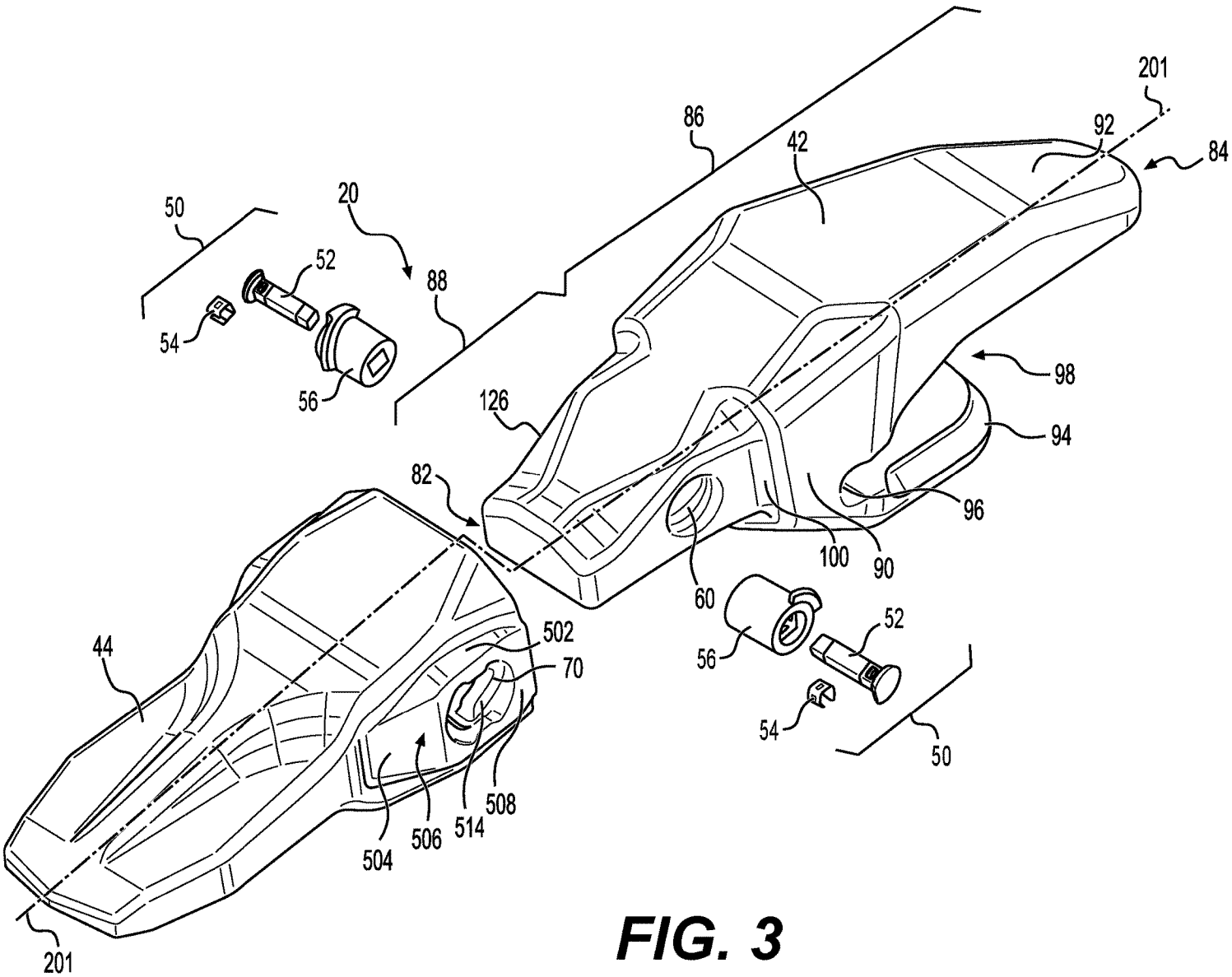
FIG. 3 is an exploded view of an exemplary tip assembly for the working implements of FIGS. 1 and 2.

FIG. 3 is an exploded view illustrating components of an exemplary tip assembly 20. Tip assembly 20 may be used on multiple types of ground engaging implements that have a base edge, such as base edge 22 or 38 (see FIGS. 1, 2). Tip assembly 20 may include an adapter 42 configured for attachment to a base edge, such as the base edge 22 or 38 of the implement 10 or 30, respectively, and a ground engaging tip 44 configured for attachment to the adapter 42. The tip assembly 20 may further include a retention mechanism 50 for securing the ground engaging tip 44 to the adapter 42. The retention mechanism 50 may comprise a center pin 52, one or more center pin clips 54, and one or more main retainers 56. Adapter 42 may include retainer opening 60 configured to receive main retainer 56. In some exemplary embodiments, adapter 42 may include a retainer opening 60 on either side of adapter 42 to receive a pair of main retainers 56 of retention mechanisms 50 from opposite sides of the adapter 42. Tip 44 may include one or more transverse thru holes 70 (one transverse thru hole 70 shown in FIG. 3). In some exemplary embodiments, tip 44 may include transverse thru holes 70 on either side of tip 44 to receive main retainers 56 of retention mechanisms 50 from opposite sides of the tip 44. Center pin clip 54 may be attachable to center pin 52, which may be insertable into main retainer 56. Once attached to adapter 42, tip 44 may extend outwardly from base edge 22 or 38 of work implement 10 or 30, respectively, for initial engagement with work material. As illustrated in FIG. 3, adapter 42 and tip 44 may have a coextensive longitudinal axis 201 that may pass through a cross-sectional center of the tip 44 and the adapter 42.

Adapter 42 may extend from adapter front end 82 to adapter rear end 84. Adapter 42 may include adapter rear portion 86 and nose 88. Adapter rear portion 86 may include strap wall 90, upper strap 92 and lower strap 94. In some exemplary embodiments, upper strap 92 may be disposed at a position higher than lower strap 94 relative to a direction of gravity. It is contemplated however that in some embodiments, upper strap 92 may be disposed at a position lower than lower strap 94. Accordingly, the terms upper and lower should be understood as merely defining positions relative to each other and not necessarily relative to a direction of gravity. Upper strap 92 may extend from the rear face 96 of strap wall 90 in a direction from adapter front end 82 towards adapter rear end 84. Similarly lower strap 94 may extend from the rear face 96 of strap wall 90 in a direction from adapter front end 82 towards adapter rear end 84. Upper strap 92 and lower strap 94 may have the same or different lengths, weights, and/or shapes. Upper strap 92 and lower strap 94 may be spaced apart from each other by gap 98 that may be configured to receive base edge 22 or 38 of work implement 10 or 30, respectively. Base edge 22 or 38 of work implement 10 or 30, respectively, when inserted into gap 98 may abut against rear face 96 of strap wall 90. Adapter 42 may be attached to base edge 22 or 38 of work implement 10 or 30, respectively, using fasteners, such as, bolts, nuts, screws, rivets, and/or using welding, brazing, or any other method of attachment.

Figure 5:
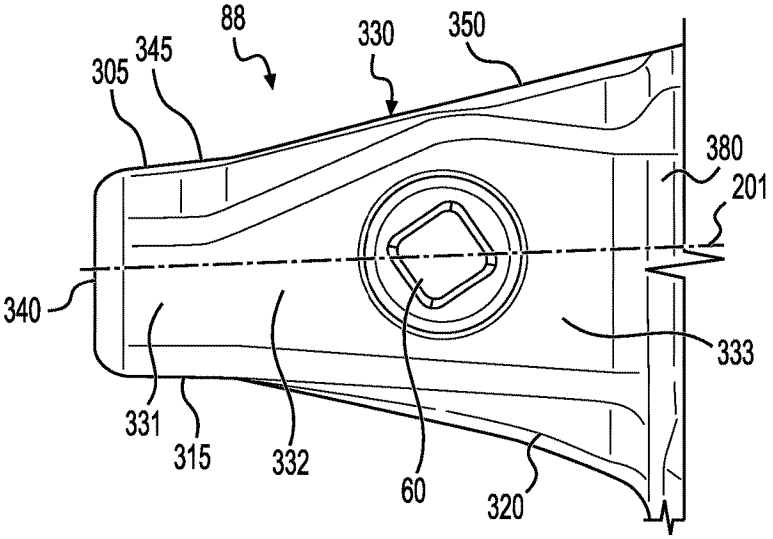
FIG. 5 is a side view of the exemplary nose of FIG. 4.
Figure 4:
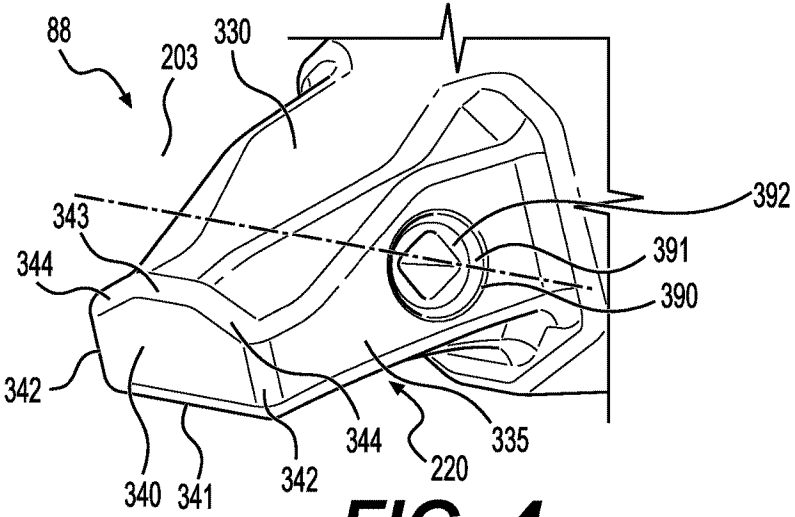
FIG. 4 is a pictorial illustration of an exemplary nose of an adapter for the tip assembly of FIG. 3.
Figure 6:
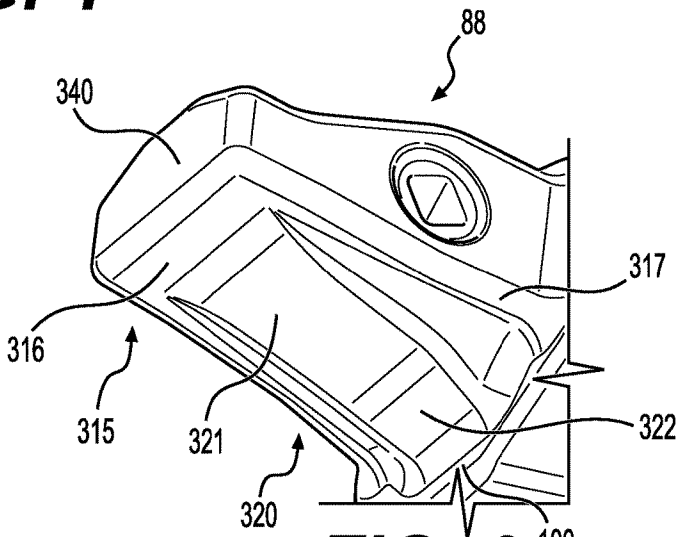
FIG. 6 is another pictorial illustration of the exemplary nose of FIG. 4.

FIGS. 4-6 depict various views of the nose 88 of adapter 42 (see FIG. 3) As depicted in FIGS. 4-6, nose 88 of adapter 42 may be an asymmetrical nose having a bottom surface 315 and a top surface 330 differently shaped from the bottom surface 315. Nose 88 may also include opposing side surfaces 335, a front surface 340, and a rear edge 380 that may abut on a front face 100 (see FIG. 3) of strap wall 90 (see FIG. 3). The rear edge 380 may coincide with a plane disposed generally perpendicular to the longitudinal axis 201 (see FIG. 3) and intersecting with the adapter 42 at a location at which the adapter 42 has its largest cross-sectional area (e.g., at front face 100 of strap wall 90). Rear edge 380 may abut on front face 100 of strap wall 90.

The bottom surface 315 may comprise a generally planar front portion 316 disposed proximate to and extending rearwardly (e.g., in a direction from adapter front end 82 toward adapter rear end 84 of FIG. 3) from the front surface 340, and a rear portion 317 extending rearwardly from the front portion 316 toward the rear edge 380 of nose 88. The bottom surface 315 may provide a stable surface to act as a contact area when the tip 44 is subjected to an upward load, while reducing wear on the tip assembly 20 (see FIGS. 1-3). The top surface 330 of nose 88 may be configured to support the ground engaging tip 44 (see FIG. 3) during use of the implement 10 or 30 (see FIGS. 1-2) and to facilitate retention of the ground engaging tip 44 on the nose 88 when bearing a load of work material. The top surface 330 may include a plurality of surfaces as explained below.

As depicted in FIG. 5, the nose 88 may include surfaces such as a generally planar front-side surface 305 disposed proximate to the front surface 340, a generally planar intermediate-side surface 345 extending rearwardly (e.g., in a direction from adapter front end 82 towards adapter rear end 84 of FIG. 3) from the front-side surface 305, and a rear-side surface 350 extending rearwardly from the intermediate-side surface 345 to the rear edge 380 of the nose 88. The front surface 340 of the nose 88 may be planar as shown in FIGS. 4-6. In other embodiments (not shown), it may include a degree of curvature. As depicted in FIG. 4, front surface 340 may be hexagonally shaped comprising a bottom edge 341, opposing side edges 342 oriented at about 90° with respect to the bottom edge 341, a top horizontal edge 343 oriented about parallel to the bottom edge 341, and opposing top sloping edges 344 connecting the top horizontal edge 343 to the side edges 342. It is contemplated, however, that in some exemplary embodiments, front surface 340 may have a triangular, square, rectangular, circular, elliptical, polygonal, or any other shape.

As depicted in FIG. 6, nose 88 may also include a bottom rib 320 of the bottom surface 315. The bottom rib 320 of the bottom surface 315 may comprise a generally planar front rib portion 321 inclined downwardly (e.g., in a direction from top surface 330 towards bottom surface 315) relative to the bottom surface 315, and a generally planar rear rib portion 322 inclined downwardly relative to the front rib portion 321, between opposing rib side surfaces. The bottom rib 320 may provide increased stability during side loading and increased wedging during push-on loading.

The side surfaces 335 of nose 88 may be generally planar and extend between the bottom surface 315 and the top surface 330. As depicted in FIG. 5, the side surfaces 335 (see FIG. 4) may comprise a generally planar front side surface 331 disposed proximate to the front surface 340, a generally planar intermediate side surface 332 extending rearwardly from the front side surface 331, and a rear side surface 333 extending rearwardly from the intermediate side surface 332 to the rear edge 380 of the nose 88.

Side surfaces 335 may include a retainer opening 60. A central axis 203 (see FIG. 4) of the retainer opening 60 may extend substantially perpendicular (or transverse) to the longitudinal axis 201 (see FIGS. 3 and 5) of the adapter 42. Retainer opening 60 may extend partway into a thickness of the nose 88 and may be configured to receive at least a portion of the main retainer 56 (see FIG. 35). Retainer opening 60 may comprise outer angled surface 390, inner side surface 391, and inner bottom surface 392, as depicted in FIG. 4. Outer angled surface 390 may provide an angled connection (such as a bevel) between side surface 335 and inner side surface 391 of retainer opening 60. Outer angled surface 390 may extend around an outer perimeter of inner side surface 391 of retainer opening 60. Outer angled surface 390 may further comprise a partially or fully rounded connection between the inner side surface 391 and side surface 335. Retainer opening 60 may further comprise inner side surface 391, as depicted in FIG. 4. Inner side surface 391 may have a generally cylindrical shape. Inner side surface 391 may be located between outer angled surfaces 390 and inner bottom surface 392. Inner side surface 391 may define a perimeter of retainer opening 60 into which main retainer 56 may be inserted. An outer surface 246 of the main retainer 56 may be spaced apart from inner side surface 391 (see FIG. 35) when the main retainer is in its locked position. Inner bottom surface 392 may be disposed generally perpendicular to inner side surface 391 and to central axis 203.

Figure 7:
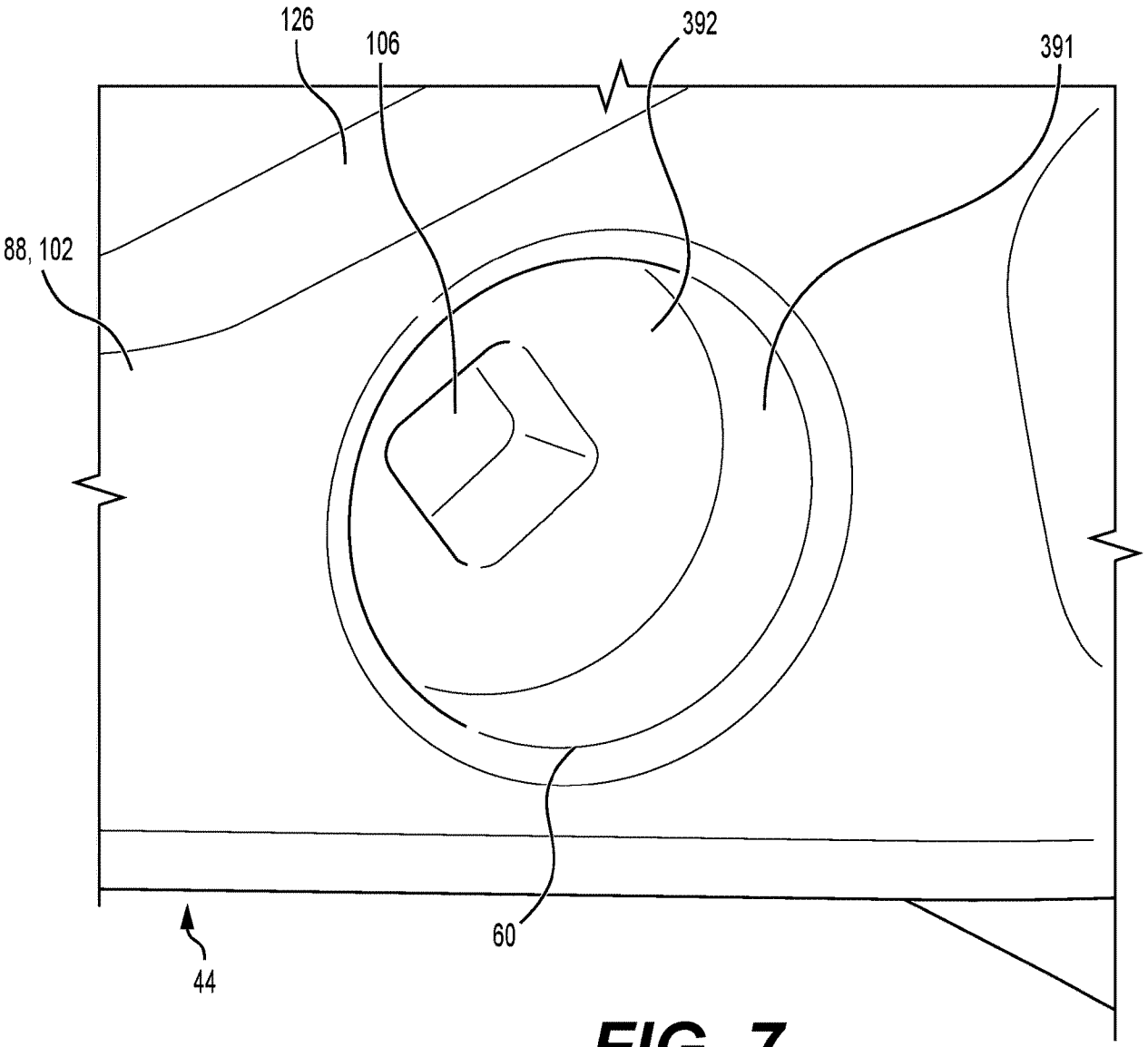
FIG. 7 is a perspective detail view of an exemplary retainer opening for the nose of FIGS. 5-6.

FIG. 7 illustrates features on one side of the adapter nose 88, including the retainer opening 60 extending into the nose 88 or 102 of the adapter 42 in a direction transverse to a central longitudinal axis 201 (see FIG. 5) of the adapter 42. As illustrated in FIG. 7, the retainer opening 60 may include a blind hole 106 with a non-circular cross-section (the exemplary embodiment of the blind hole 106 shown in FIG. 7 has a substantially square cross-section) extending further into the nose 88 of the adapter 42 from the inner bottom surface 392 of the retainer opening 60. Various alternative embodiments may include other non-circular profiles, such a triangular profile, rectangular profile, or a polygona profile for the blind hole 106.

Figure 9:
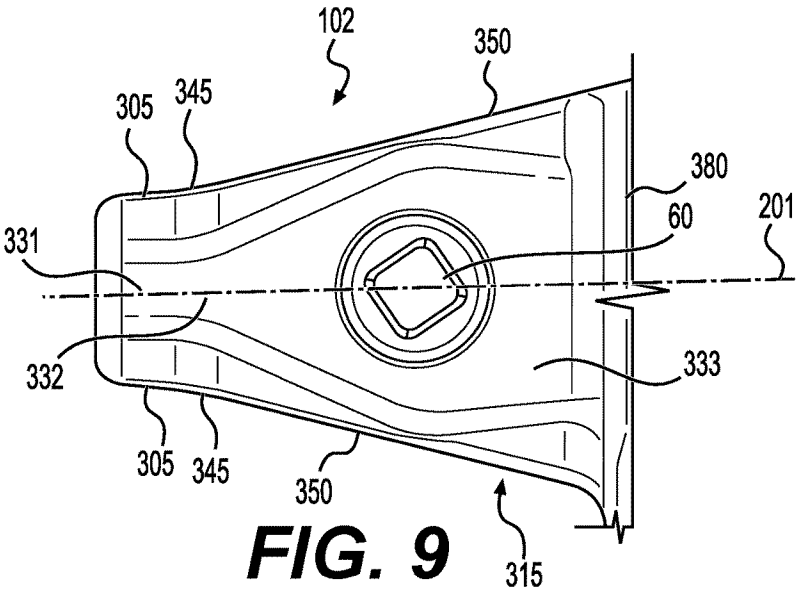
FIG. 9 is a side view of the exemplary nose of FIG. 8.
Figure 8:
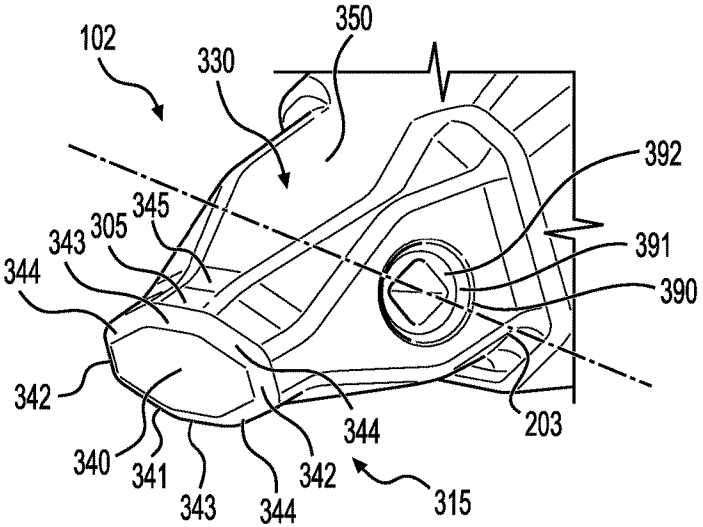
FIG. 8 is a pictorial illustration of another exemplary nose of an adapter for the tip assembly of FIG. 3.
Figure 10:
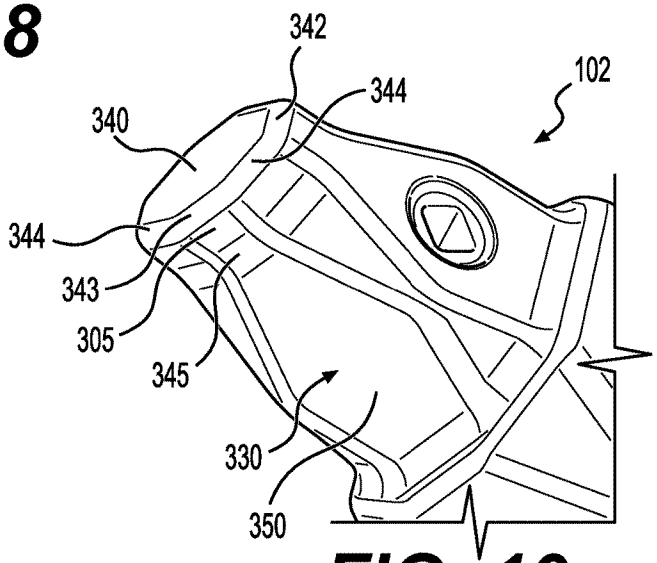
FIG. 10 is another pictorial illustration of the exemplary nose of FIG. 8.

Although nose 88 has been described above as an asymmetrical nose because top surface 330 includes features different from bottom surface 315, it is contemplated that in some exemplary embodiments, adapter 42 may have a symmetrical nose that may take the place of nose 88 of FIG. 3. FIGS. 8-10 depict various views of a symmetrical nose 102 of adapter 42 (see FIG. 3) As depicted in FIGS. 8-10, nose 102 of adapter 42 may be a symmetrical nose having a bottom surface 315 that may be similarly shaped as a top surface 330, opposing side surfaces 335, a front surface 340, and a rear edge 380 that may abut on a front face 100 (see FIG. 3) of strap wall 90 (see FIG. 3). The rear edge 380 may coincide with a plane disposed generally perpendicular to the longitudinal axis 201 (see FIG. 3) and intersecting with the adapter 42 at a location at which the adapter 42 has its largest cross-sectional area (e.g., at front face 100 of strap wall 90). Rear edge 380 may abut on front face 100 of strap wall 90.

As depicted in FIG. 9, top surface 330 of the nose 102 may include surfaces such as a generally planar front-side surface 305 disposed proximate to the front surface 340, a generally planar intermediate-side surface 345 extending rearwardly (e.g., in a direction from adapter front end 82 towards adapter rear end 84 of FIG. 3) from the front-side surface 305, and a rear-side surface 350 extending rearwardly from the intermediate-side surface 345 to the rear edge 380 of the nose 102. Like the top surface 330, the bottom surface 315 of nose 102 may also comprise a generally planar front-side surface 305 disposed proximate to the front surface 340, a generally planar intermediate-side surface 345 extending rearwardly (e.g., in a direction from adapter front end 82 towards adapter rear end 84 of FIG. 3) from the front-side surface 305, and a rear-side surface 350 extending rearwardly from the intermediate-side surface 345 to the rear edge 380 of the nose 102.

The front surface 340 of the nose 102 may be planar as shown in FIGS. 8-10. In other embodiments (not shown), it may include a degree of curvature. As depicted in FIG. 8, front surface 340 may be octagonally shaped comprising opposing top and bottom edges 341, opposing side edges 342 oriented at about 90° with respect to opposing top and bottom edges 341, a top horizontal edge 343 oriented about parallel to the bottom horizontal edge 343, opposing sloping edges 344 connecting the top horizontal edge 343 to the side edges 342, and opposing sloping edges 344 connecting the bottom horizontal edge 343 to the side edges 342. It is contemplated, however, that in some exemplary embodiments, front surface 340 of symmetrical nose 102 may have a square, rectangular, circular, elliptical, polygonal, or any other shape.

The side surfaces 335 of nose 102 may be generally planar and extend between the bottom surface 315 and the top surface 330. As depicted in FIG. 9, the side surfaces 335 (see FIG. 8) may comprise a generally planar front side surface 331 disposed proximate to the front surface 340, a generally planar intermediate side surface 332 extending rearwardly from the front side surface 331, and a rear side surface 333 extending rearwardly from the intermediate side surface 332 to the rear edge 380 of the nose 102. Side surfaces 335 of nose 102 may include a retainer opening 60 that may be similar to the retainer opening 60 described above in connection with nose 88.

Figure 11:
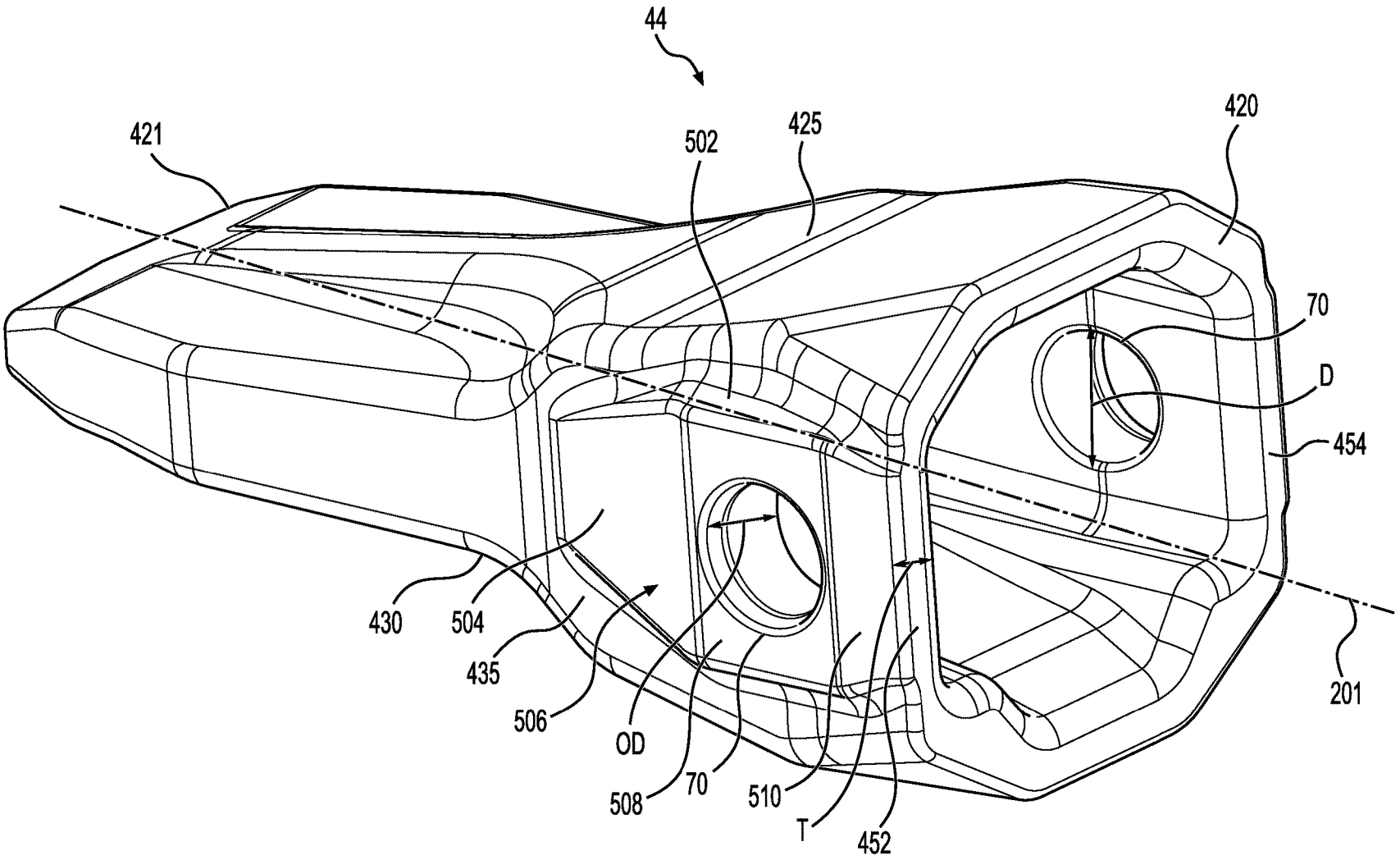
FIG. 11 is perspective view of an exemplary tip for the tip assembly of FIG. 3.

FIG. 11 depicts ground engaging tip 44. The ground engaging tip 44 may be generally wedge-shaped and have a rear edge 420 that may be configured to abut on front face 100 (see FIG. 3) of strap wall 90 (see FIG. 3) of nose 88 (see FIGS. 4-6) or symmetrical nose 102 (see FIG. 8-10). The tip 44 may have a top outer surface 425 extending forward (e.g., in a direction from adapter rear end 84 towards adapter front end 82 of FIG. 3) from a top of the rear edge 420, and a bottom outer surface 430 extending forward from a bottom of the rear edge 420 of ground engaging tip 44. The top outer surface 425 and the bottom outer surface 430 may be angled toward each other such that the top outer surface 425 and the bottom outer surface 430 converge at a front edge 421 at the front of the ground engaging tip 44. A nose cavity 440 may be defined within the ground engaging tip 44. Nose cavity 440 may extend from rear edge 420 into tip 44 in a forward direction (e.g., direction from rear edge 420 toward front edge 421). Nose cavity 440 may define a pair of lateral side walls 452, 454 that may extend between top outer surface 425 and bottom outer surface 430. Lateral side walls 452, 454 of tip 44 may include lateral outer surfaces 435 extending between the top outer surface 425 and the bottom outer surface 430 on either side of ground engaging tip 44 with the transverse thru hole 70 passing through each of lateral side walls 452, 454 for installation of the center pin 52, center pin clip 54, and main retainer 56 (see FIG. 3).

Figure 12:
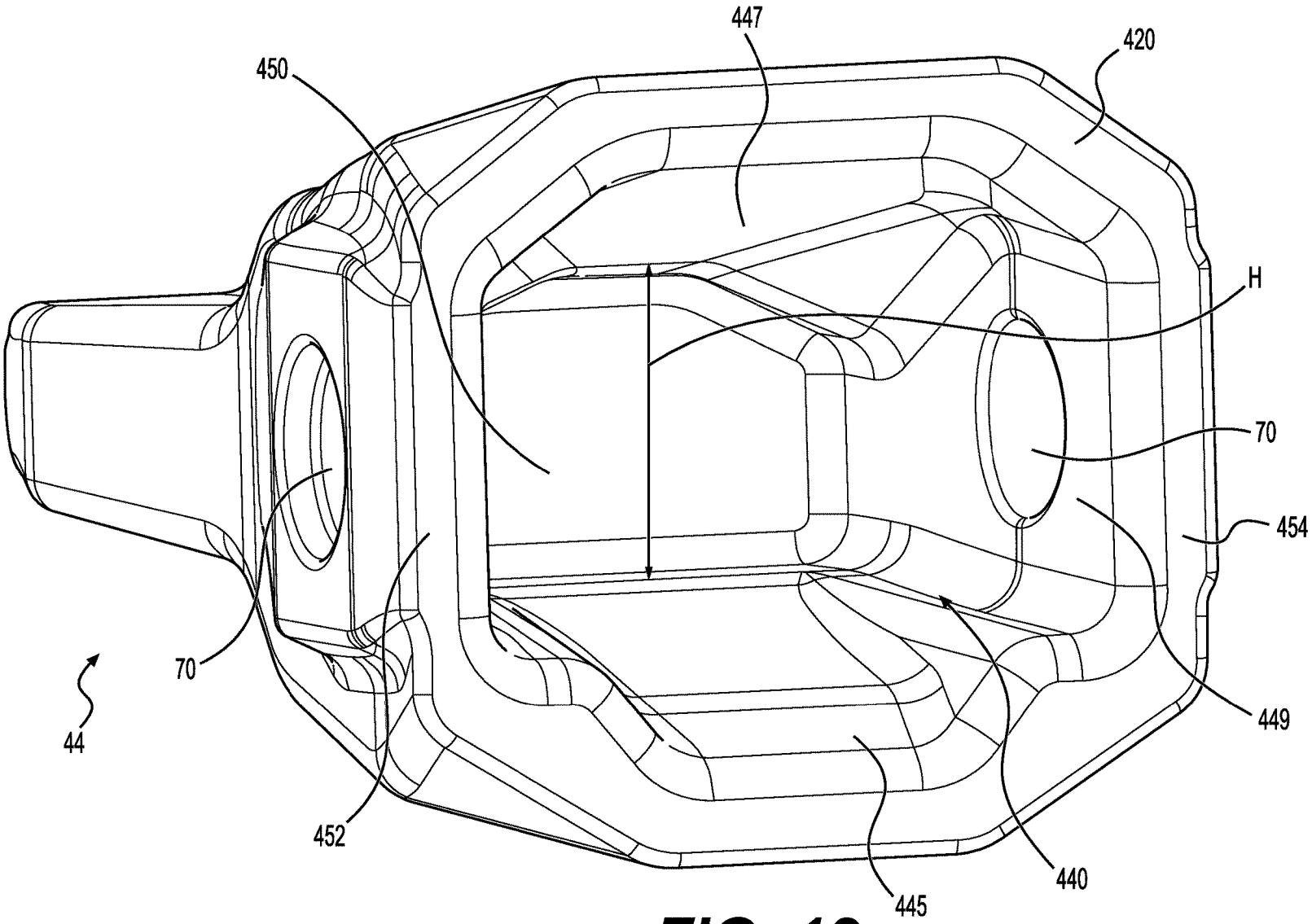
FIG. 12 is another perspective view of the tip of FIG. 11.

As depicted in FIG. 11, lateral outer surfaces 435 of ground engaging tip 44 may include transverse thru holes 70 in one or both of lateral side walls 452, 454 for receiving the main retainer 56 (see FIG. 3) when ground engaging tip 44 is installed on the adapter 42 (see FIG. 3). Transverse thru hole 70 may be a thru-hole passing through one or both of lateral side walls 452 and 454 such that transverse thru hole 70 is in communication with nose cavity 440. One of the transverse thru holes 70 may be disposed on the external surface 508 of the tip ear pad 506 and an opposite end of the transverse thru hole 70 may be disposed on the side inner surface 449 (see FIG. 12) of the nose cavity 440. When tip 44 is attached to adapter 42, transverse thru hole 70 may be aligned with retainer opening 60 in adapter 42. In some exemplary embodiments, ground engaging tip 44 may include the transverse thru hole 70 on both lateral side walls 452, 454, as depicted in FIGS. 11, 12. In other exemplary embodiments, tip 44 may include the transverse thru hole 70 on only one of the lateral side walls 452 or 454. As illustrated in FIG. 11, the transverse thru hole 70 may comprise a diameter D and an opening depth OD through thickness T of lateral side wall 452 or 454. Opening depth OD may be the same depth as ground engaging tip thickness T of lateral side wall 452 or 454 or up to three times the depth of ground engaging tip thickness T. In one exemplary embodiment, as depicted in FIG. 11, opening depth OD may be twice the depth of ground engaging tip thickness T. Diameter D of the transverse thru hole 70 may range between 40 percent to 100 percent of height H, as depicted in FIG. 12. In one exemplary embodiment as depicted in FIG. 11 and FIG. 12, diameter D of the transverse thru hole 70 may be sixty percent of height H.

Ground engaging tip 44 may be configured to be received onto the nose 88 (see FIG. 4) or nose 102 (see FIG. 8). As illustrated in FIG. 12, a nose cavity 440 may be defined within the ground engaging tip 44. In some exemplary embodiments, the nose cavity 440 of tip 44 may be asymmetrical and may have a complimentary configuration to receive the nose 88. For example, asymmetrical nose cavity 440 may include a bottom inner surface 445, a top inner surface 447, a pair of opposing side inner surfaces 449, and a front inner surface 450 that may match with corresponding outer surfaces of asymmetrical nose 88 to allow asymmetrical nose 88 to be received in asymmetrical nose cavity 440. In some exemplary embodiments, the nose cavity 440 may be symmetrical and may have a complimentary configuration to receive the symmetrical nose 102. For example, the bottom inner surface 445, top inner surface 447, pair of opposing side inner surfaces 449, and front inner surface 450 may have shapes and dimensions that may match with corresponding outer surfaces of symmetrical nose 102 to allow symmetrical nose 102 to be received in symmetrical nose cavity 440.

As illustrated in FIG. 11, tip 44 may include a tip ear pad 506 that may be formed (e.g., by casting) on at least one lateral outer surface 435. Tip ear pad 506 may include tip ear pad front surface 504 that may extend rearwardly (e.g., in a direction from tip front edge 421 toward tip rear edge 420). Tip ear pad front surface 504 may be inclined outwardly relative to lateral outer surface 435 in a transverse direction (e.g., direction generally perpendicular to longitudinal axis 201 and going from lateral side wall 454 towards lateral side wall 452). Tip ear pad 506 may also include external surface 508 of the tip ear pad 506. External surface 508 may extend rearwardly from tip ear pad front surface 504. Tip ear pad 506 may include tip ear pad rear surface 510 that extend rearwardly from external surface 508. Tip ear pad rear surface 510 may connect with lateral outer surface 435 adjacent rear edge 420. Tip ear pad rear surface 510 may be inclined inwardly relative to lateral outer surface 435 in a transverse direction (e.g., direction generally perpendicular to longitudinal axis 201 and going from lateral side wall 452 towards lateral side wall 454). Although specific shapes of tip 44 and/or nose 88 or 102 have been discussed above, it is contemplated that retention mechanism 50 may be used to attach tips with complementary noses having shapes, sizes, dimensions, and/or configurations different from the exemplary embodiments described above.

Figure 14:
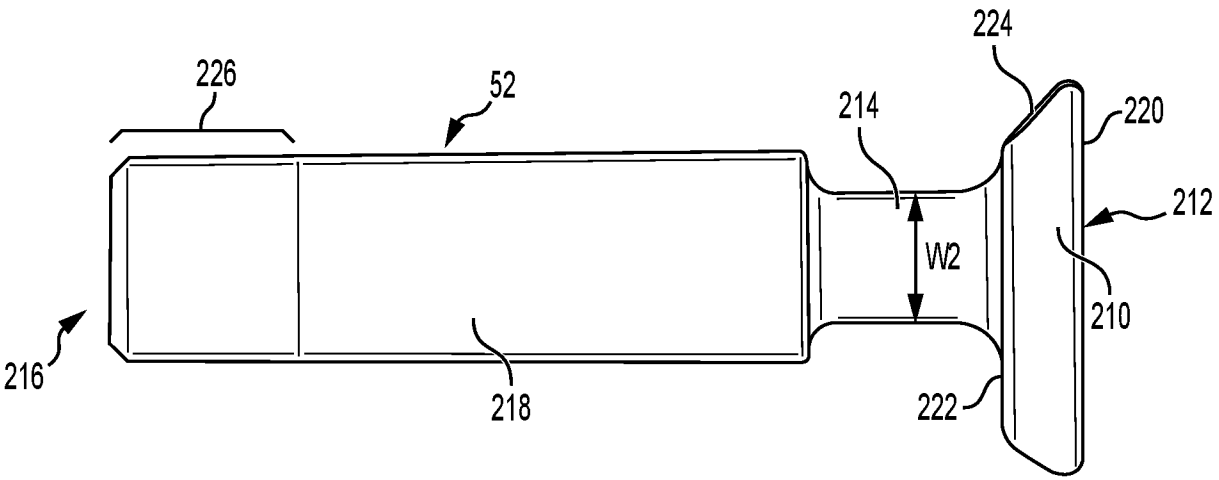
FIG. 14 is a side elevation view of the exemplary center pin of FIG. 13.
Figure 13:
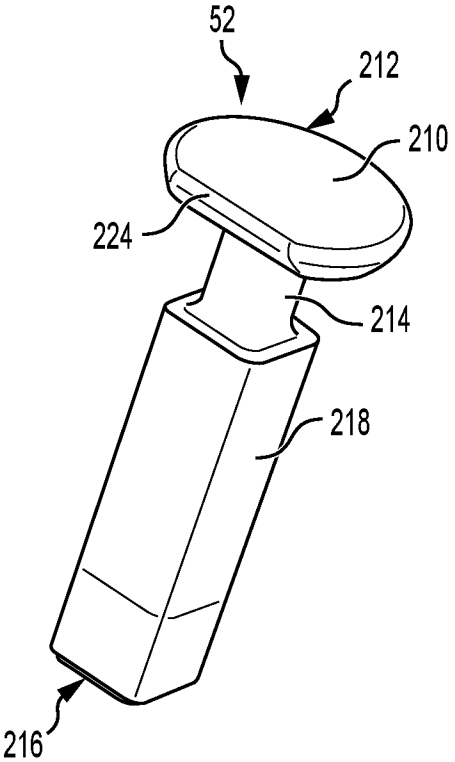
FIG. 13 is an isometric view of an exemplary center pin for the tip assembly of FIG. 3.

As discussed above, the retention mechanism 50 may include a center pin 52. FIGS. 13 and 14 illustrate an exemplary embodiment of a center pin 52 extending from a proximal end 212 of the center pin 52 to a distal end 216 of the center pin 52. Center pin 52 may include a head 210 at the proximal end 212, a neck 214 extending from the head 210 towards the distal end 216 of the center pin 52, and a shank 218 extending from the neck 214 towards the distal end 216. Head 210 may have generally planar opposing surfaces 220 and 222 facing the proximal end 212 and the distal end 216, respectively. Head 210 may have a generally circular shape with a notched portion 224 extending over a portion of the circumference of the head 210. The notched portion 224 may be configured to allow a tool such as the blade of a screwdriver to be inserted under the head 210 for prying up on the center pin 52 for removal of the center pin 52 from the main retainer 56 as will be explained below.

Shank 218 of the center pin 52 may have a non-circular cross-section. In one exemplary embodiment as illustrated in FIG. 13, shank 218 may have a square cross-section. It is contemplated, however, the shank 218 may have a triangular, rectangular, polygonal, or any other type of non-circular cross-section. The cross-sectional profile of the shank 218 may be compatible with the cross-sectional profile of the blind hole 106 of retainer opening 60 (see FIG. 7) such that shank 218 may be insertable into blind hole 106 of retainer opening 60. Shank 218 may also include shank end portion 226 extending from distal end 216 of center pin 52 partway toward proximal end 212. Shank end portion 226 may be tapered such that a cross-sectional area of shank 218 at distal end 216 may be smaller than the cross-sectional area of shank 218 adjacent neck 214. Tapered shank end portion 226 may make it easier for center pin 52 to be inserted into main retainer 56 as will be described below. Neck 214 of center pin 52 may have a cross-sectional area smaller than that of shank 218 and head 210. Thus, neck 214 may form a recess between the head 210 and the shank 218.

Figure 16:
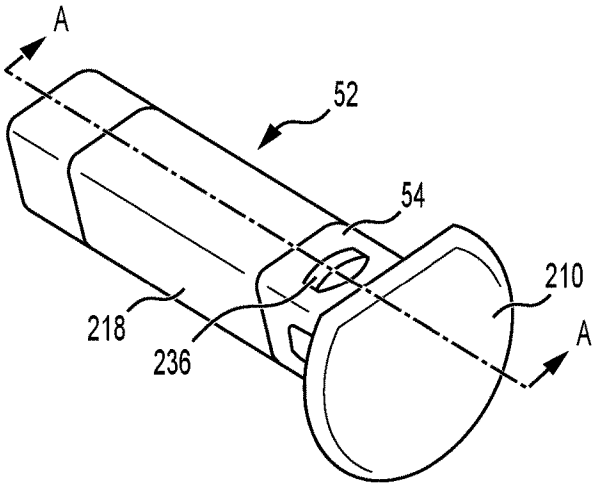
FIG. 16 is an isometric view showing the center pin clip of FIG. 15 assembled onto the center pin of FIG. 14.
Figure 17:
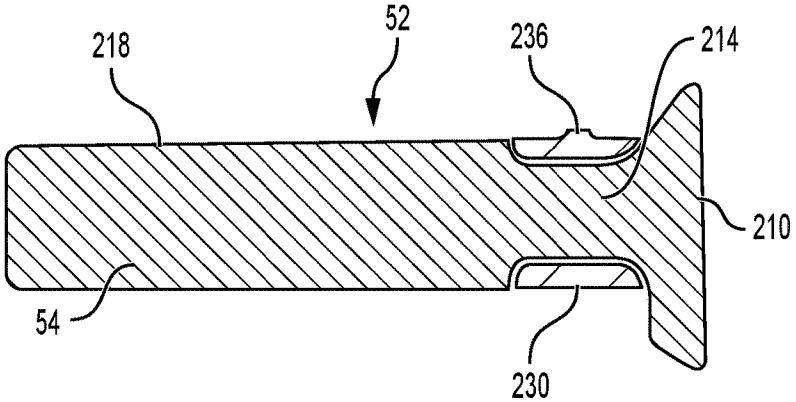
FIG. 17 illustrates a vertical cross-sectional view taken along line A-A of FIG. 16.
Figure 15:
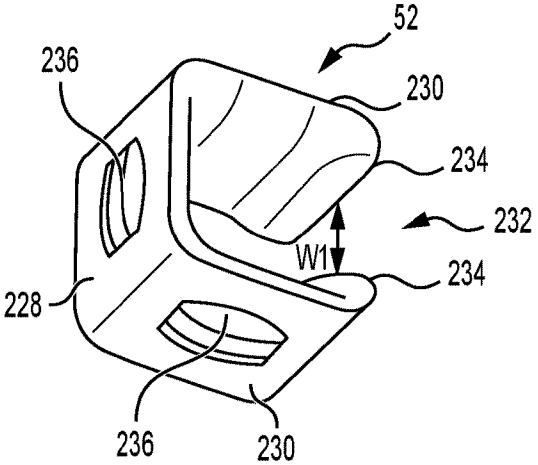
FIG. 15 is an isometric view of an exemplary center pin clip for the tip assembly of FIG. 3.

FIG. 15 illustrates a perspective view of an exemplary center pin clip 54. The center pin clip 54 may be C-shaped or U-shaped and may be configured to be installed around neck 214 of center pin 52. In one exemplary embodiment as illustrated in FIG. 15, center pin clip 54 may have a center wall 228 and legs 230 projecting from opposite ends of center wall 228. Distal ends of legs 230 may be spaced apart by a gap 232 that may be configured to receive the neck 214 allowing the center pin clip 54 to be installed around neck 214 of center pin 52. Distal ends of legs 230 may also include projections 234 extending towards each other such that a width $w_1$ of gap 232 may be smaller than a width $w_2$ (see FIG. 14) of neck 214, allowing projections 234 to wrap around neck 214 helping to ensure center pin clip 54 may not be easily dislodged from neck 214 after installation. One or more of center wall 228 and/or legs 230 may include protrusions 236 that may be configured to engage with detents in an inner wall of the main retainer 56, as will be described below. FIG. 16 illustrates an exemplary perspective view of center pin clip 54 installed on center pin 52 around neck 214 of center pin 52. FIG. 17 illustrates a vertical cross-sectional view taken along line A-A of FIG. 16. As illustrated in FIG. 17, legs 230 of center pin clip 54 may be positioned around neck 214 such that neck 214 of center pin 52 may be disposed between legs 230 of center pin clip 54. Furthermore, protrusion 236 may extend outward in a direction away from outer surfaces of shank 218 of center pin 52 and legs 230 of center pin clip 54. The center pin clip 54 may be formed from plastic, rubber, metal, or other materials with elastic properties such that the legs 230 of center pin clip 54 may be flexed apart for installation around neck 214 of center pin 52.

Figure 19:
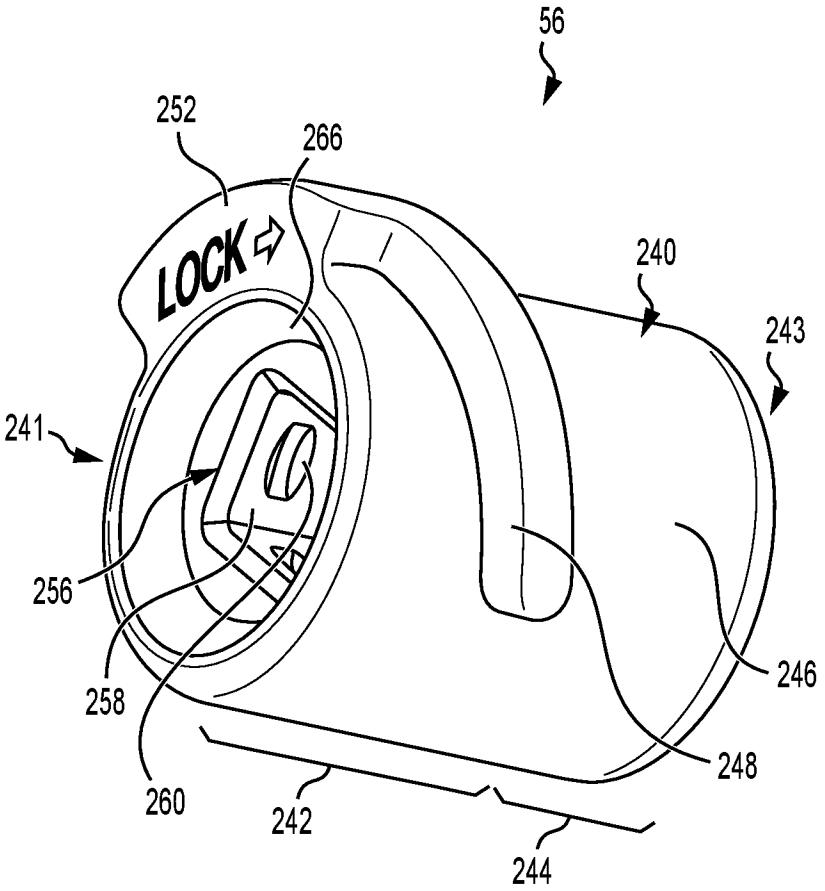
FIG. 19 is another isometric view of the exemplary main retainer of FIG. 18.
Figure 18:
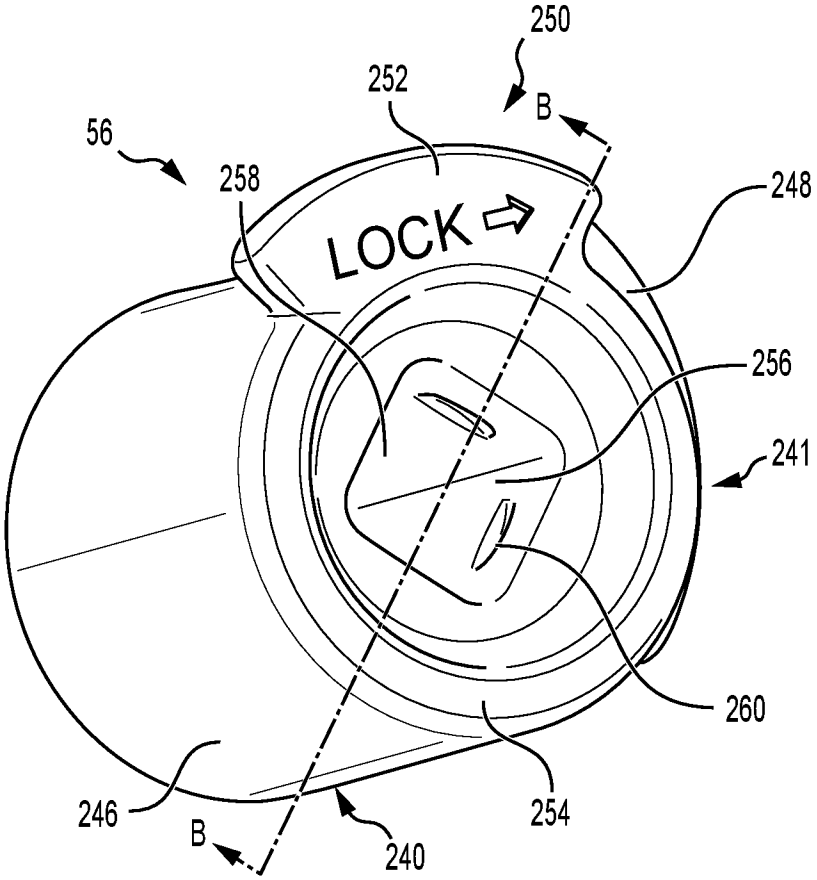
FIG. 18 is an isometric view of an exemplary main retainer for the tip assembly of FIG. 3.

FIGS. 18 and 19 illustrate perspective views of an exemplary main retainer 56. Main retainer 56 may include a retainer body 240 that may extend from a retainer proximal end 241 to a retainer distal end 243. Retainer body 240 of main retainer 56 may have a generally cylindrical outer surface 246 and a partial male thread 248 wrapped part way around the outer surface 246. In one exemplary embodiment as illustrated in FIG. 19, the partial male thread 248 may be wrapped around threaded portion 242 of the retainer body 240. Threaded portion 242 may be disposed adjacent to retainer proximal end 241. In alternative embodiments, the male thread 248 on the main retainer 56 may be wrapped completely around the outer surface 246 of the retainer body 240 over an angle of 360 degrees or more. Male thread 248 may include proximal tab portion 250 in the form of a helical ramp segment along a leading end of the male thread 248, with a top surface 252 of the ramp segment being substantially coplanar with an end surface 254 of the main retainer 56 at the retainer proximal end 241 of the main retainer 56. The top surface 252 of the helical ramp segment may include a marking (e.g. "LOCK") indicating a direction of rotation of the main retainer 56 during installation of the main retainer 56 in tip 44 as will be described below. Retainer body 240 may include a non-threaded portion 244 disposed adjacent retainer distal end 243. Non-threaded portion 244 may not include any portion of the male thread 248. Main retainer 56 may include a thru hole 256 that may extend from adjacent retainer proximal end 241 to retainer distal end 243 of main retainer 56. Thru hole 256 may have a non-circular cross-section that may match (e.g., have a similar or identical shape as) a cross-sectional profile of shank 218 (see FIGS. 13, 14, 16, 17) of center pin 52 and blind hole 106 (see FIG. 7) of retainer opening 60. For example, the cross-section of thru hole 256 may be square, rectangular, triangular, polygonal, or may have any other shape that matches (e.g., has a similar or identical shape as) a cross-sectional profile of shank 218 and blind hole 106 such that center pin 52 may be insertable into thru hole 256 and into blind hole 106. As also illustrated in FIGS. 18 and 19, an inner wall 258 of thru hole 256 may include one or more indentations or detents 260 that may be configured to engage with an receive protrusions 236 (see FIGS. 15-17) of center pin clip 54. For example, when thru hole 256 has a square cross-section, some or all four inner walls 258 of thru hole 256 may include one or more detents 260.

Figure 21:
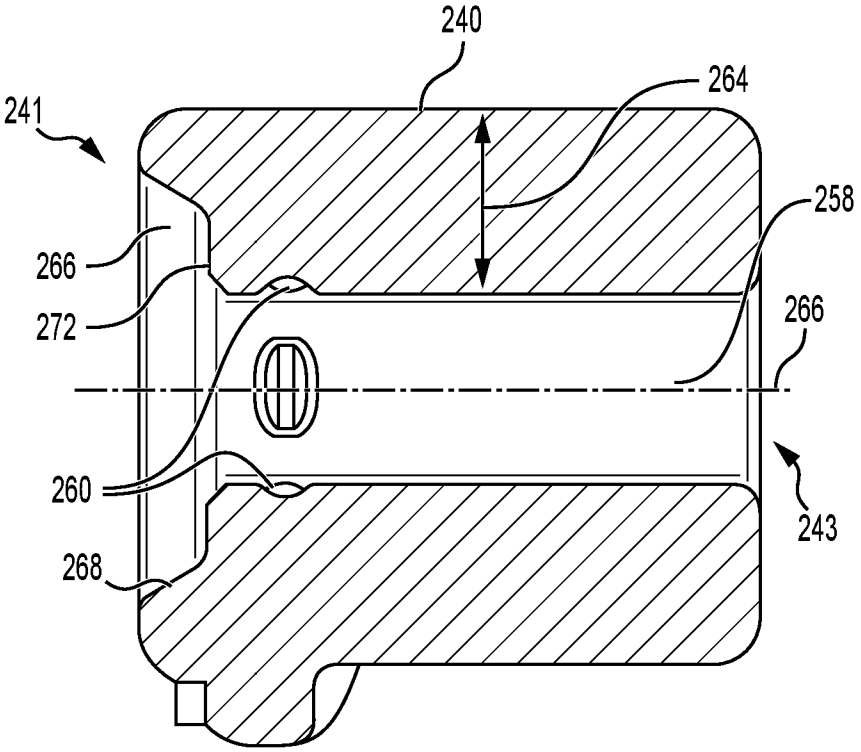
FIG. 21 is a vertical cross-sectional view along line B-B in FIG. 18 of the main retainer of FIG. 18.
Figure 20:
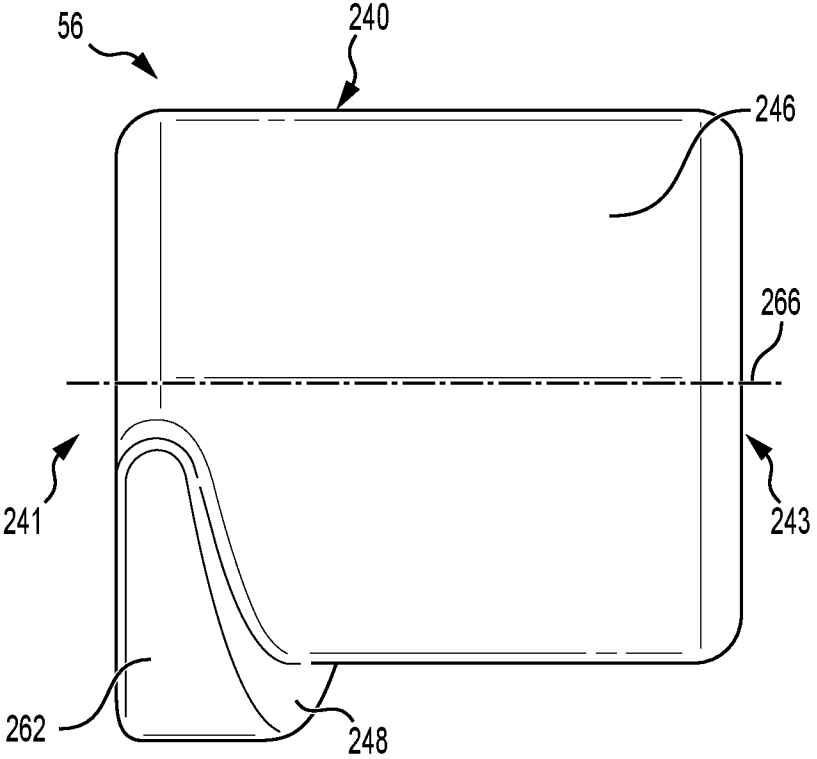
FIG. 20 is a side elevation view of the exemplary main retainer of FIG. 18.

FIG. 20 illustrates a side elevation view of the main retainer 56. As illustrated in FIG. 20, the helical ramp segment at the leading end of the male thread 248 may form a wedge shape 262 that may be configured to fill the gap at the entrance to a female thread wrapped at least part way around the inner circumferential surface of the transverse thru hole 70 passing through the lateral side wall of the tip 44. This helical ramp segment may assist in blocking dirt from entering into the threadedly engaged portions of the main retainer 56 and the tip 44 during operation of the machine, thus prolonging the life of the components and making it easier to remove the main retainer when desired for replacement of parts. FIG. 21 illustrates a cross-sectional view along line B-B (see FIG. 18) of the main retainer 56. As shown in detail in FIG. 21, the non-circular profile of the center pin and the thru hole 256 extending along the central axis 266 of the main retainer 56 allows for thicker main retainer walls 264 than would be the case with a round center pin or a threaded center pin, thus providing more shear strength against forces tending to remove the tip 44 from the adapter nose 88 or 102 of the adapter 42. As also illustrated in FIG. 21, thru hole 256 may include a counterbore 268 extending into the retainer body 240 of the main retainer 56 from retainer proximal end 241. As illustrated in FIG. 19, counterbore 268 may have a generally circular shape with an inner surface 270 of counterbore 268 tapering inwards in a direction from retainer proximal end 241 towards retainer distal end 243. Counterbore 268 may also include a base 272 that may be disposed generally perpendicular to the central axis 266 of the main retainer 56. As also illustrated in FIG. 21, detent 260 in thru hole 256 may be positioned between the base 272 of the counterbore and the retainer distal end 243. Further, as illustrated in FIG. 21, detent 260 may be positioned nearer to counterbore 268 and to retainer proximal end 241 as compared to retainer distal end 243.

As illustrated in FIGS. 3 and 11, tip 44 may include a tip ear pad 506 that may be formed (e.g., by casting) on at least one lateral outer surface 435 (see FIG. 11) of the tip 44. Tip ear pad 506 may be configured with the transverse thru holes 70 passing through the lateral side wall 452 and/or 454 (see FIG. 11) of the tip 44 in a direction perpendicular to a coextensive central longitudinal axis 201 (see FIGS. 3 and 11) of the tip 44 and the adapter 42 when the tip 44 is assembled on the nose 88 or 102 of the adapter 42.

Figure 23:
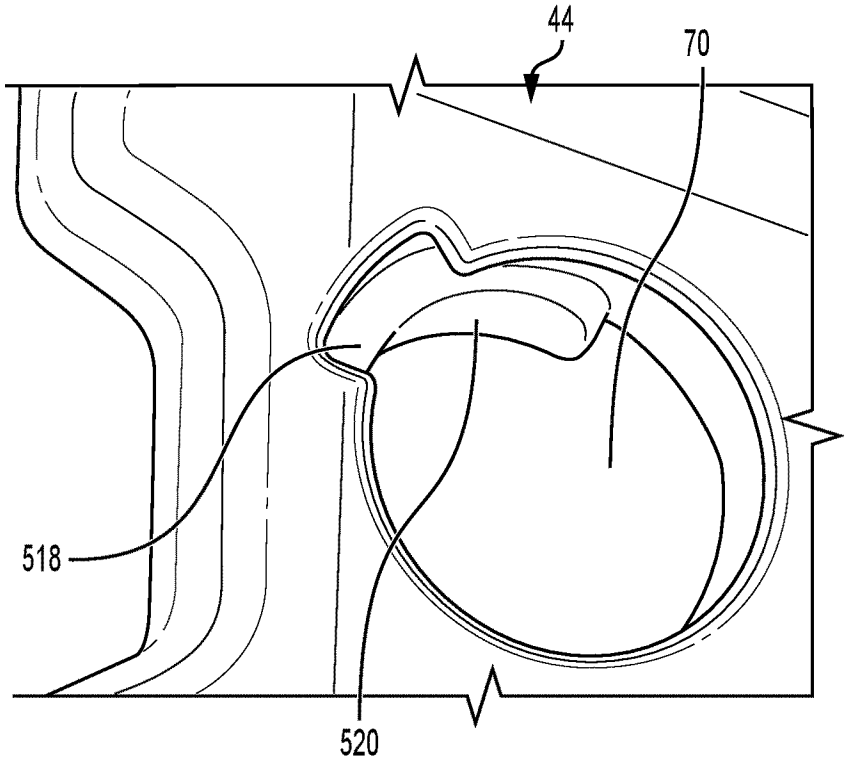
FIG. 23 is a magnified exemplary inner side view of the transverse thru hole of FIG. 22.
Figure 22:
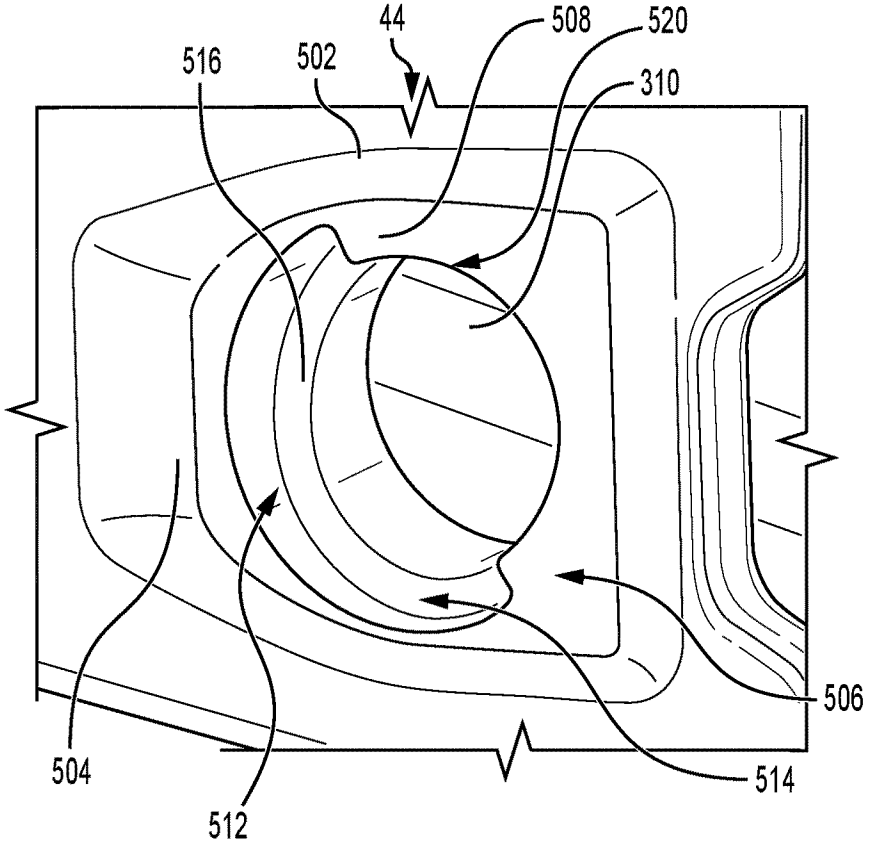
FIG. 22 is a magnified outer side view of an exemplary transverse thru hole in the tip of FIGS. 11 and 12.

FIG. 22 is a perspective view of the tip ear pad 506 looking inwardly into the nose cavity of the tip 44. FIG. 23 is a perspective view looking outwardly from the nose cavity 440 of the tip 44 through the lateral side wall 452 or 454 of the tip 44. As illustrated in FIG. 22, the transverse thru hole 70 may include a partial female thread/ramp structure 514 defined only part way around an inner circumferential wall 512 of the transverse thru hole 70 through the lateral side wall 452 or 454 of the tip 44 (see FIG. 11). The partial female thread 514 may help reduce the distance between an external surface 508 of the tip ear pad 506 and the surrounding outer surface of the lateral side wall 452 or 454 of the tip 44. The partial male thread 248 extending part way around the outer surface 246 of the main retainer 56, as shown in FIGS. 22 and 23, may engage with an external surface 516 of the female thread 514 as the main retainer 56 is threadedly engaged in the transverse thru hole 70. Rotation of the main retainer 56 into threaded engagement with the female thread 514 and into a locked position may result in the partial male thread 248 sliding along the female thread/ramp structure 514 and passing underneath a portion of the partial female thread 514 such that an internal surface 518 of the female thread (see FIG. 19) forms a ledge 520 that prevents removal of the main retainer 56 in an axial direction without counter-rotating the main retainer 56 to unthread it from the female thread 514 in the transverse thru hole 70 through the lateral side wall 452 or 454 of the tip 44.

INDUSTRIAL APPLICABILITY

The disclosed retention mechanism for ground engaging tools may be applicable to various earth-working machines, such as, for example, excavators, wheel loaders, hydraulic mining shovels, cable shovels, bucket wheels, bulldozers, and draglines. When installed, the disclosed configurations of an exemplary retention mechanism and components may provide secure and reliable attachment and detachment of ground engaging tools to and from various earth-working implements. In particular, certain configurations of the disclosed retention mechanisms may address certain issues associated with work material getting into the space around the retention mechanism and increasing friction between components of the retention mechanism and/or between the retention mechanism and a ground engaging tool. Moreover, certain configurations of the disclosed retention mechanism may increase the strength of the retention mechanism against forces that may cause separation of the tip from the adapter, improve the manufacturability of the various components, and simplify installation and removal of the tip from the adapter.

Figure 24:
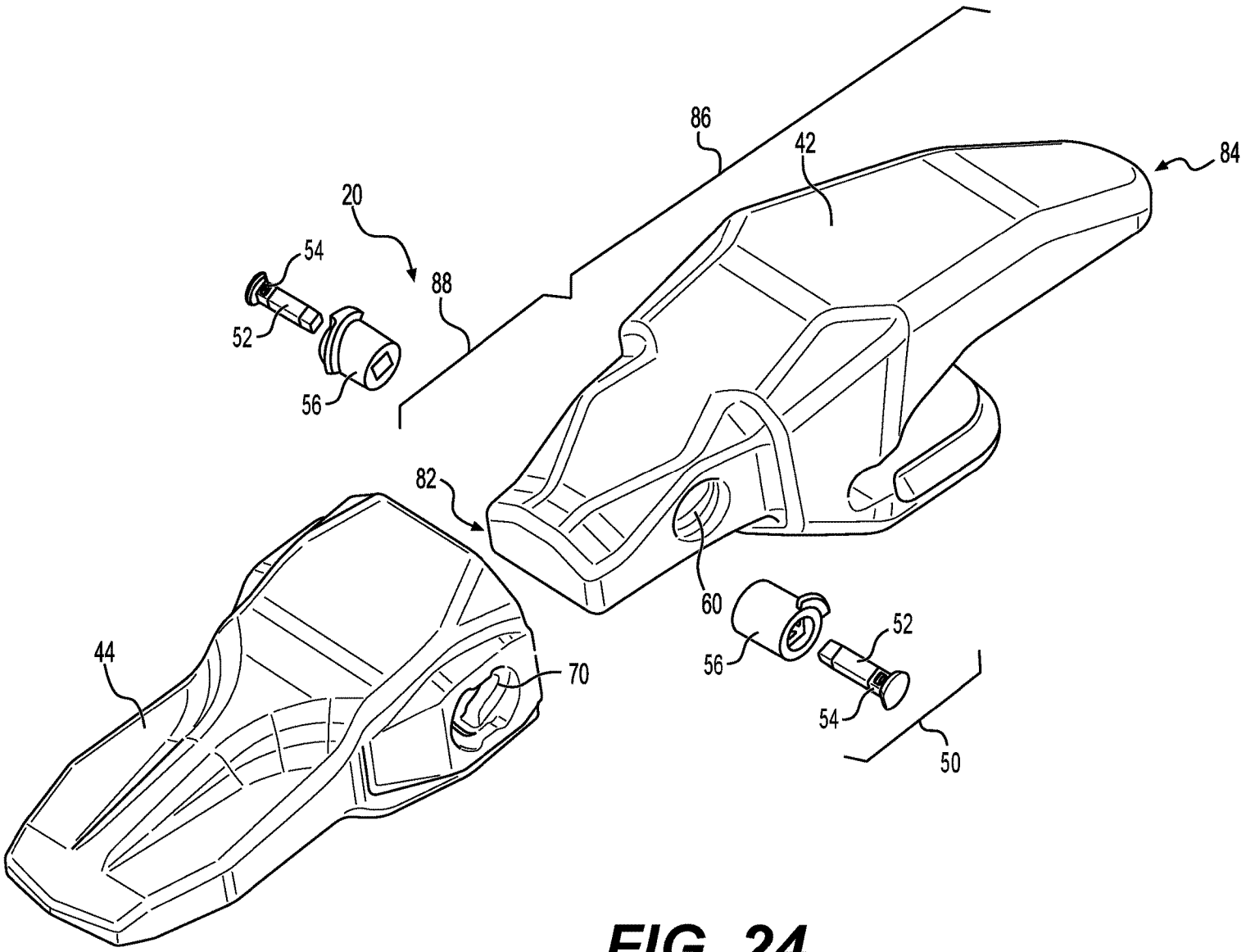
FIG. 24 is an exploded perspective view of the tip assembly of FIG. 3 with the center pin clip of FIG. 15 assembled on the center pin of FIG. 14.
Figure 25:
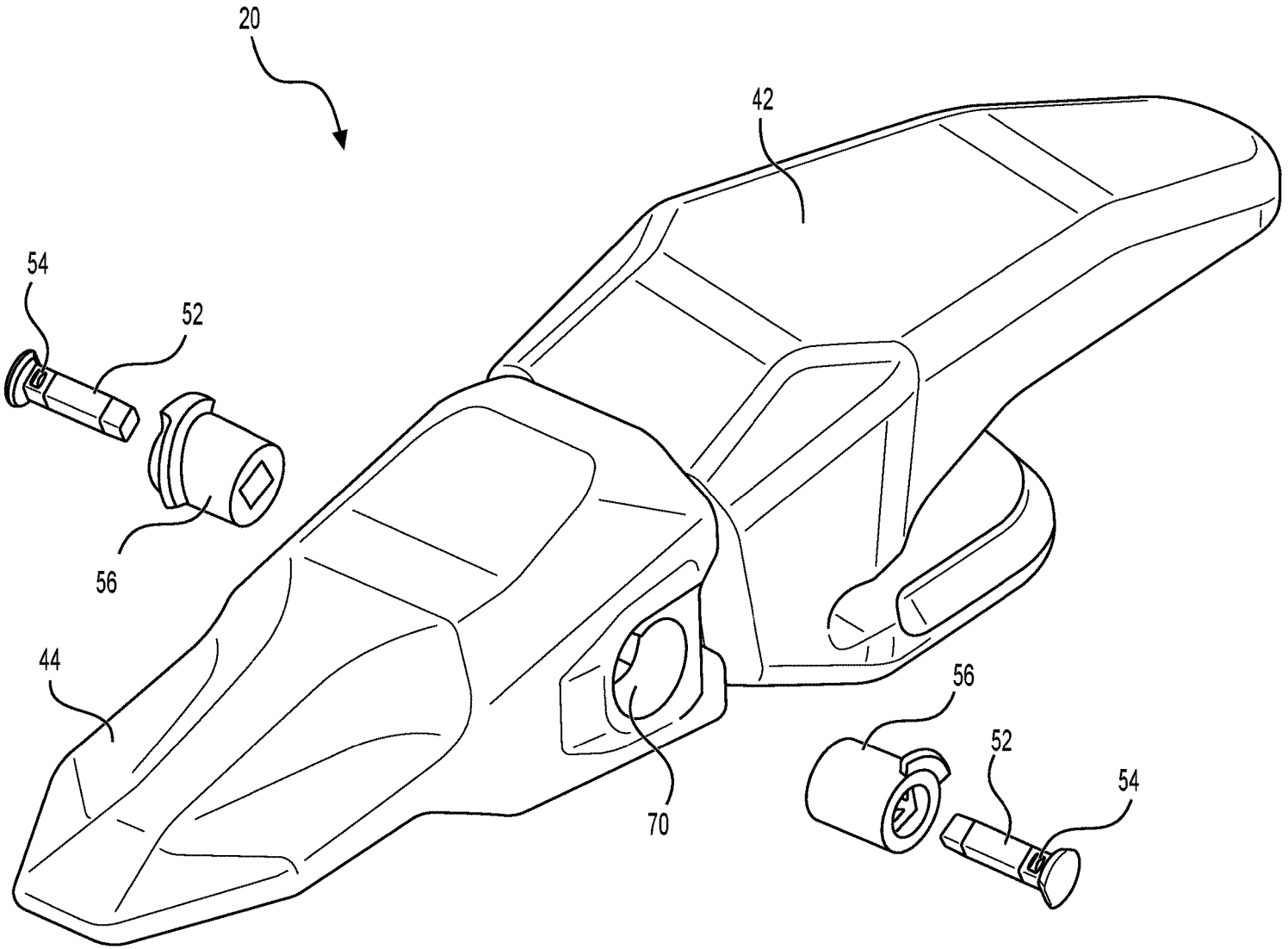
FIG. 25 is perspective view of the tip assembly of FIG. 24 with the tip attached to the adapter.

One exemplary implementation of this disclosure includes a method for removably attaching the tip 44 to the adapter 42 fixed to an earth-moving implement of an earth-working machine. FIGS. 3 and 24-27 illustrate assembly of the adapter 42, tip 44, and retention mechanism 50, of the tip assembly 20 of FIGS. 1 and 2, according to an exemplary implementation of the present disclosure. As illustrated in FIG. 24, the adapter 42 may include a retainer opening 60 extending into the nose 88 or 102 of the adapter 42 in a direction transverse to a longitudinal axis 201 (see FIG. 3) of the adapter 42. As also illustrated in FIG. 24, the center pin clip 54 may be installed on center pin 52 such that center wall 228 and legs 230 of center pin clip 54 (see FIG. 15) may abut on to neck 214 (see FIG. 14) of center pin 52. Further, as discussed above, the retainer opening 60 may include a blind hole 106 with a non-circular cross-section extending further into the nose 88 or 102 (see FIGS. 8-10) of the adapter 42 from the inner bottom surface 392 (see FIG. 7) of the retainer opening 60. The method for removably attaching the tip 44 to the adapter 42 may include positioning the nose 88 or 102 of the adapter 42 inside a nose cavity 440 (see FIG. 12) of the tip 44, the nose cavity 440 having a longitudinal axis coextensive with the longitudinal axis 201 (see FIG. 3) of the adapter 42. The nose 88 or 102 may be positioned inside nose cavity 440 such that the blind hole 106 (see FIG. 7) in the retainer opening 60 of the nose 88 or 102 of the adapter 42 may be axially aligned with the transverse thru hole 70 extending through a lateral side wall 454, 454 (see FIG. 12) of the tip 44. FIG. 25 illustrates an exemplary partial tip assembly 20 in which nose 88 or 102 of adapter 42 has been inserted into nose cavity 440 of tip 44. As illustrated in FIG. 25, both main retainer 56 and center pin 52 may remain outside the adapter 42 and tip 44 at this stage of the assembly.

Figure 26:
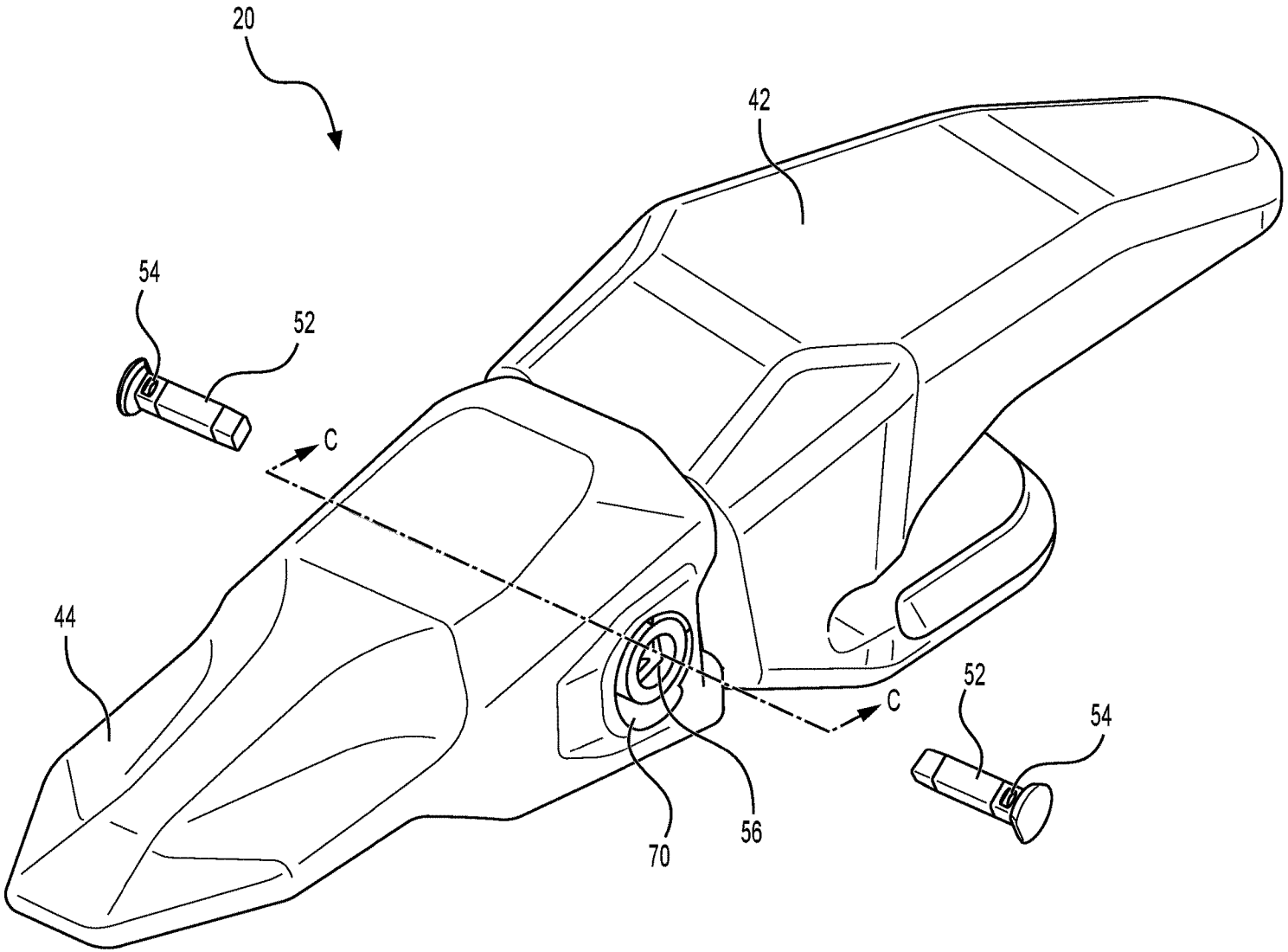
FIG. 26 is perspective view of the tip assembly of FIG. 24 in which the main retainer of FIGS. 18-21 has been inserted into the transverse thru hole of FIG. 22.

After positioning the nose 88 or 102 of the adapter 42 inside the nose cavity 440 of the tip 44, the method may include inserting a main retainer 56 with a non-circular thru hole 256 extending along a central axis of the main retainer 56 into the transverse thru hole 70 extending through the lateral side wall 452 or 454 of the tip 44. FIG. 26 illustrates an exemplary partial tip assembly 20 in which nose 88 or 102 of adapter 42 has been inserted into nose cavity 440 of tip 44 and the main retainer 56 has been inserted into the transverse thru hole 70. As illustrated in FIG. 26, only the center pin 52 may remain outside the adapter 42, tip 44, and the main retainer 56 at this stage of the assembly.

Figure 29:
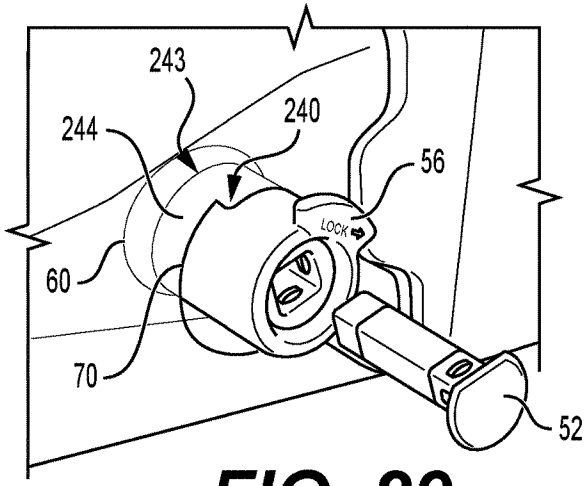
FIG. 29 depicts a three dimensional rendering of the main retainer FIGS. 18-21 after insertion into the transverse thru hole of FIG. 22, while the main retainer is in an unlocked position.
Figure 28:
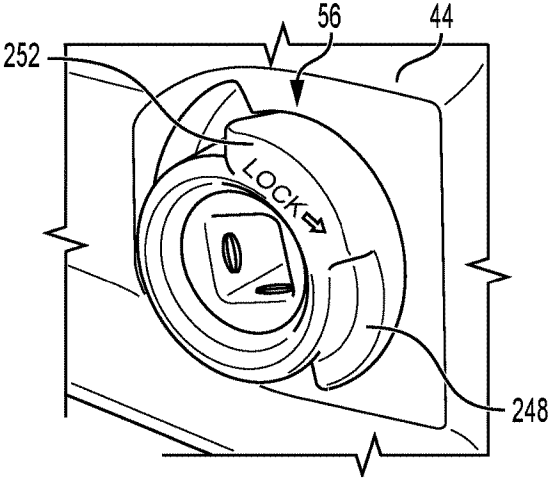
FIG. 28 illustrates the main retainer of FIGS. 18-21 after insertion into the transverse thru hole of FIG. 22, while the main retainer is in an unlocked position.

FIG. 28 illustrates the main retainer 56 after insertion into the transverse thru hole 70 and while in an unlocked position (e.g., in a position before it has been rotated). Thus the male thread 248 of the main retainer 56 is disengaged from the female thread 514 in the transverse thru hole 70 of the tip 44. FIG. 29 depicts a three dimensional rendering of the main retainer 56 after it has been inserted into the transverse thru hole 70 of the tip 44. As illustrated in FIG. 29, the non-threaded portion 244 of the retainer body 240 adjacent retainer distal end 243 remains disengaged from the transverse hole 70 in the adapter 42.

Figure 31:
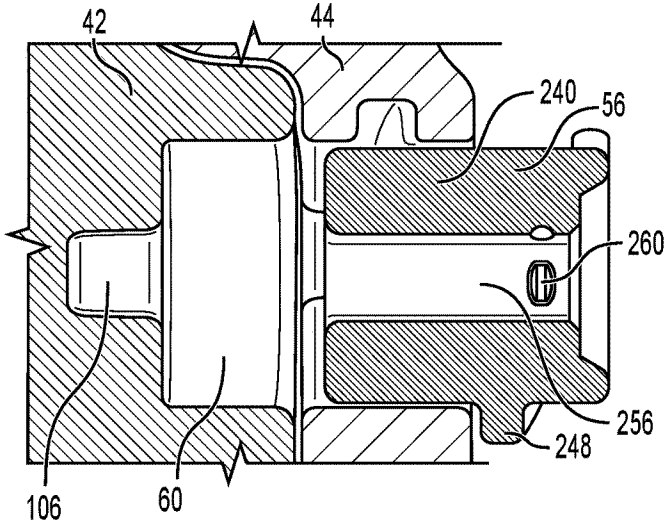
FIG. 31 is a vertical cross-sectional view of a portion of the tip assembly of FIG. 26, taken along line C-C of FIG. 26.
Figure 30:
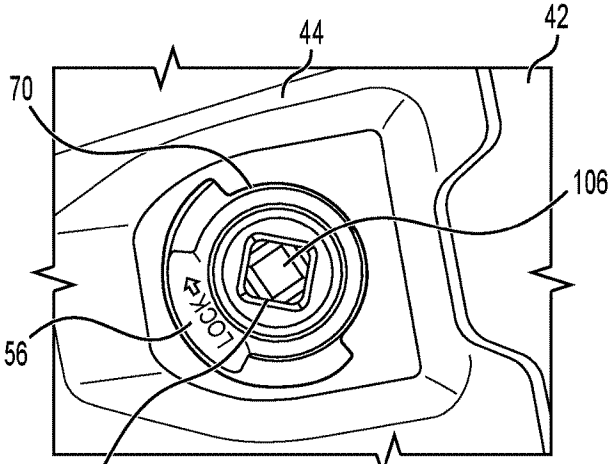
FIG. 30 illustrates a misalignment of the non-circular thru hole in the main retainer of FIGS. 18-21 and the matching non-circular blind hole of the adapters of FIG. 4-10 when the main retainer is in an unlocked position.

FIG. 30 illustrates the main retainer 56 after insertion into the transverse thru hole 70 passing through the lateral side wall 453, 454 of the tip 44 and while in the unlocked position. In this position, the non-circular thru hole 256 extending along the central axis 266 of the main retainer 56 is not aligned with the matching non-circular blind hole 106 of the adapter 42. FIG. 30 illustrates the misalignment of the non-circular thru hole 256 with the matching non-circular blind hole 106 of the adapter 42 when the main retainer 56 is in an unlocked position. As seen in FIG. 30, the square cross-section of the non-circular thru hole 256 in the main retainer 56 is rotated relative to the non-circular blind hole 106 in the adapter 42. In this position, the center pin 52 cannot be inserted through the non-circular thru hole 256 of the main retainer 56 into the non-circular blind hole 106 in the adapter 42. FIG. 31 is a cross-sectional view of a portion of the tip assembly taken along line C-C of FIG. 26. As illustrated in FIG. 31, the main retainer 56 is disengaged from the adapter 42, with the male thread 248 outside of the tip 44.

Returning to FIG. 27, assembly of the tip 44 onto the adapter 42 may further include rotating the main retainer 56 to threadedly engage a partial male thread 248 wrapped at least part way around an outer surface 246 of the main retainer 56 with a partial female thread 514 defined in and wrapped part way around an inner circumferential wall 512 of the transverse thru hole 70. Rotation of the main retainer 56 into a locked position includes rotating the main retainer 56 until the non-threaded portion 244 of the retainer body 240 of the main retainer 56 has entered the retainer opening 60 in the nose 88 or 102 of the adapter 42 and the non-circular thru hole 256 of the main retainer 56 is aligned with the non-circular blind hole 106 into the nose 88 or 102 of the adapter 42.

Figure 33:
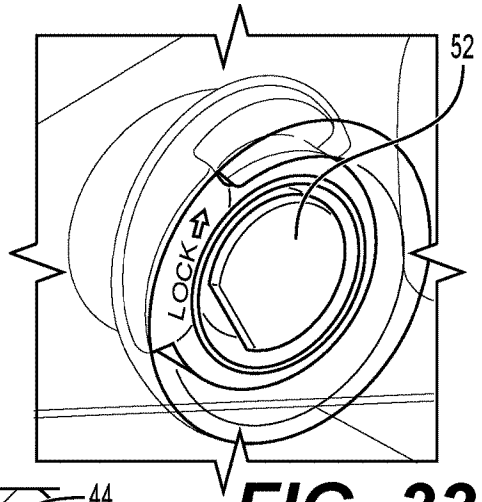
FIG. 33 depicts a three dimensional rendering of the main retainer FIGS. 18-21 after insertion into the transverse thru hole of FIG. 22, when the main retainer is in the locked position.
Figure 32:
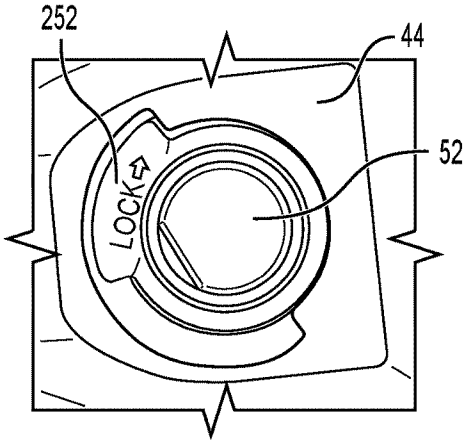
FIG. 32 illustrates the main retainer of FIGS. 18-21 after insertion into the transverse thru hole of FIG. 22, when the main retainer is in a locked position.
Figure 34:
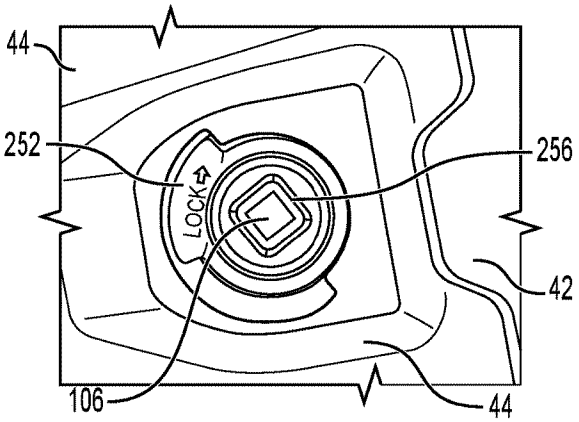
FIG. 34 illustrates alignment of the non-circular thru hole in the main retainer of FIGS. 18-21 and the matching non-circular blind hole of the adapters of FIG. 4-10 when the main retainer is in the locked position.

FIG. 32 illustrates the main retainer 56 in a locked position after it has been rotated. When the main retainer 56 is rotated, the male thread 248 of the main retainer 56 engages with the female thread 514 in the transverse thru hole 70 of the tip 44. FIG. 33 depicts a three dimensional rendering of the main retainer 56 after it has been rotated into the transverse thru hole 70 of the adapter 42. FIG. 34 illustrates the main retainer 56 after insertion into the transverse thru hole 70 passing through the lateral side wall 453, 454 of the tip 44 and while in the locked position. As illustrated in FIG. 34, in this position, the non-circular thru hole 256 extending along the central axis 266 (see FIG. 21) of the main retainer 56 is aligned with the matching non-circular blind hole 106 of the adapter 42. In this position, the center pin 52 can be inserted through the non-circular thru hole 256 of the main retainer 56 into the non-circular blind hole 106 in the adapter 42.

Returning to FIG. 27, the method of assembly of the tip 44 onto the adapter 42 may still further include inserting a center pin 52 with a complementary non-circular profile through the thru hole 256 in the main retainer 56 such that the distal end 216 of the center pin 52 enters and engages with the blind hole 106 in the nose 88 or 102 of the adapter 42 to prevent the main retainer 56 from being unthreaded from the tip 44 until the center pin 52 is removed from the main retainer 56. As discussed above, shank end portion 226 (see FIG. 14) of the center pin 52 may be tapered for ease of insertion of center pin 52 into the thru hole 256 in the main retainer 56. Furthermore, when center pin 52 is inserted into hole 256, protrusions 236 on center wall 228 and/or legs 230 of center pin clip 54 may engage with one or more detents 260 in thru hole 256. The engagement of the protrusions 236 on the center pin clip 54 with the detents 260 defined in the inner walls 258 of the thru hole 256 of the main retainer 56 may prevent the center pin 52 from disengagement from the main retainer 56 until a prying force is exerted against an underside of the notched portion 224 of the head 210 of the center pin 52 (see FIGS. 13, 14) in a direction away from the main retainer 56.

Figure 27:
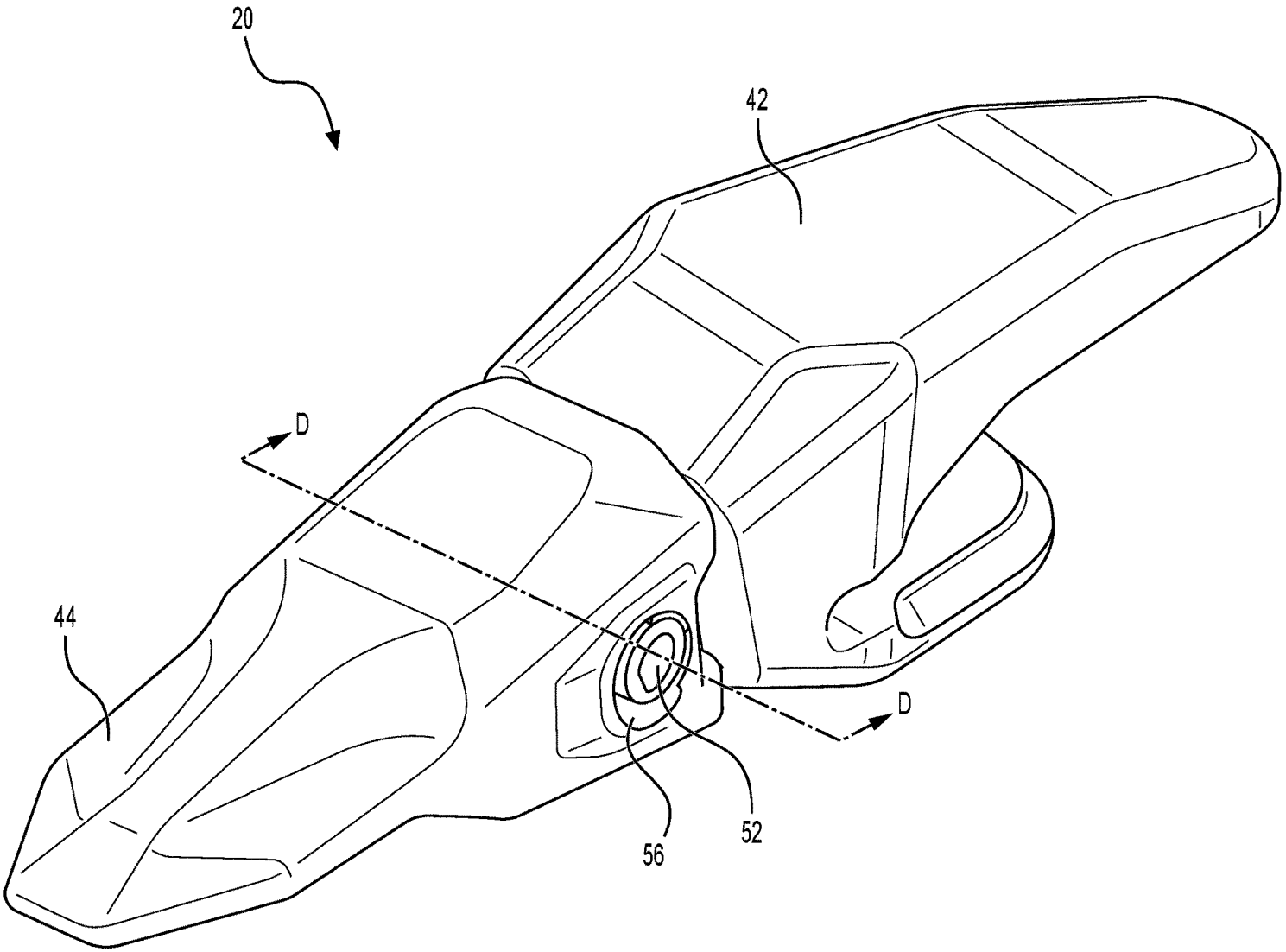
FIG. 27 is perspective view of the tip assembly of FIG. 24 in which the center pin assembly of FIG. 16 has been inserted into the main retainer of FIGS. 18-21.
Figure 35:
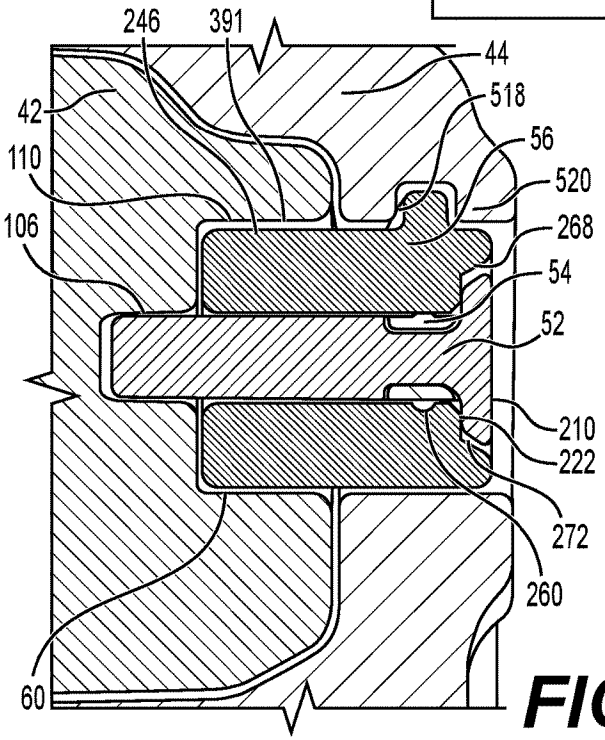
FIG. 35 is a vertical cross-sectional view of a portion of the tip assembly of FIG. 27, taken along line D-D of FIG. 27.

FIG. 35 is a cross-sectional view of a portion of the tip assembly taken along line D-D of FIG. 27. As illustrated in FIG. 35, after rotation of the main retainer 56 and insertion of the center pin 52, the main retainer 56 may be engaged with the adapter 42, with the male thread 248 between an internal surface 518 of the female thread 514 and ledge 520. As also seen in FIG. 35, planar surface 222 of the head 210 of the center pin 52 may abut on the base 272 of the counterbore 268 in the main retainer 56. Furthermore, outer surface 246 of retainer body 240 of the main retainer 56 may be spaced apart from inner side surface 391 of the retainer opening 60. When the nose 88 of the adapter 42 is fully engaged with the nose cavity 440 of the tip 44, and the center pin 52 has been inserted through the non-circular thru hole 256 of the main retainer 56, a distal end of the center pin 52 projects from the retainer distal end 243 of the main retainer 56 and extends into the blind hole 106 of the nose 88. The matching non-circular profile of the non-circular hole 256 of the main retainer 56, the non-circular cross-section of the center pin 52, and the non-circular profile of the blind hole 106 in the nose 88 prevents the main retainer 56 from being rotated and unthreaded from the tip 44 as long as the center pin 52 remains installed through the main retainer 56 and is engaged with the blind hole 106 in the nose 88, thus acting as an anti-ejection mechanism.

To disassemble the tip 44 from the adapter 42, a prying tool such as the blade of a screwdriver may be inserted between head 210 of the center pin 52 and inner surface 270 of the counterbore 268 of the main retainer 56 to extract the center pin 52 from the thru hole 256 and the blind hole 106. After the center pin 52 has been removed, the main retainer 56 may be rotated such that the male thread 248 of the main retainer 56 disengages from the female thread 514 in the transverse thru hole 70. Counter-rotation of the main retainer 56 may enable removal of the main retainer 56 from the adapter 42 and tip 44 when removal of the tip 44 from the adapter 42 is desired for replacement of the tip 44. Once the main retainer 56 has been fully disengaged, the main retainer 56 may be extracted from the thru hole 256. The tip 44 may now be removed such that the nose 88 or 102 of the adapter 42 is extracted from nose cavity 440 of the tip 44. The center pin 52, the flexible center pin clip 54, and the main retainer 56 may all be reused, if they have not been damaged, after a new tip 44 is installed on the adapter 42.

In various exemplary implementations of a method according to this disclosure the transverse opening extending into the nose of the adapter may be one of two transverse openings extending into the nose of the adapter from each of opposite sides of the nose of the adapter in a direction transverse to the longitudinal axis of the adapter, and each of the transverse openings may include a blind hole with a non-circular cross-section extending further into the nose of the adapter from a bottom of the transverse opening. The hole extending through a side wall of the tip may be one of two holes extending through two opposite side walls of the tip in a direction transverse to the longitudinal axis of the adapter, each of the two holes being in communication with the nose cavity in the tip and aligned with one of the two transverse openings extending into the nose of the adapter on one of the opposite sides of the nose.

It will be apparent to those skilled in the art that various modifications and variations can be made to the disclosed retention mechanism. Other embodiments will be apparent to those skilled in the art from consideration of the specification and practice of the disclosed method and apparatus. It is intended that the specification and examples be considered as exemplary only, with a true scope being indicated by the following claims and their equivalents.

What is claimed is:

1. A retention mechanism for connecting a ground engaging tip to an adapter, the retention mechanism comprising:
- a main retainer, including:
  - a retainer body extending from a retainer proximal end to a retainer distal end;
  - a non-circular thru hole extending along a central axis of the main retainer; and
  - a male thread on an outer surface of the main retainer, the male thread configured to threadedly engage with a female thread in a transverse thru hole in the tip;
- a center pin, including a non-circular outer profile that matches a profile of the non-circular thru hole of the main retainer; and
- a center pin clip attachable adjacent to a proximal end of the center pin, wherein
  - the non-circular thru hole of the main retainer is configured to be aligned with a non-circular blind hole in the adapter when the main retainer is in its fully engaged position, and
  - the center pin is configured to be inserted into the non-circular thru hole of the main retainer with a distal end of the center pin positioned in the non-circular blind hole in the adapter.

2. The retention mechanism of claim 1, wherein the male thread includes a proximal tab portion in the form of a helical ramp segment along a leading end of the male thread with a top surface of the ramp segment being substantially coplanar with an end surface of the main retainer at the retainer proximal end.

3. The retention mechanism of claim 1, wherein the non-circular thru hole in the main retainer and the center pin have profiles matching a profile of the non-circular blind hole in the adapter.

4. The retention mechanism of claim 1, wherein the center pin includes:

a head disposed at a proximal end of the center pin;

a neck extending from the head towards the distal end of the center pin; and a shank extending from the neck to the distal end, the shank having the non-circular outer profile, wherein the neck has a cross-section smaller than a cross-section of the head and a cross-section of the shank.

5. The retention mechanism of claim 4, wherein the center pin clip is configured to be installed on the neck of the center pin.

6. The retention mechanism of claim 5, wherein the center pin clip includes:

a center wall; and a pair of legs projecting from opposite ends of the center wall, wherein distal ends of the legs are spaced apart by a gap configured to allow the neck of the center pin to be received in the gap.

7. The retention mechanism of claim 5, wherein the main retainer includes a detent on an inner wall of the thru hole adjacent the retainer proximal end, and the center pin clip includes a protrusion on an outer surface of the center pin clip, the protrusion being configured to engage with the detent.

8. The retention mechanism of claim 7, wherein the thru hole in the main retainer includes a counterbore extending from the retainer proximal end into the retainer body.

9. The retention mechanism of claim 8, wherein the detent is positioned between a base of the counterbore and the retainer distal end.

10. The retention mechanism of claim 4, wherein the head of the center pin includes a notched portion extending over a portion of a circumference of the head.

11. The retention mechanism of claim 4, wherein the shank of the center pin includes a shank end portion extending from the distal end of the center pin partway towards the neck, the shank end portion having a tapered cross-sectional profile.

12. A tip assembly, comprising:

an adapter configured to be fixed to a work implement, the adapter including:

a retainer opening extending into a nose of the adapter in a direction transverse to a longitudinal axis of the adapter; and a blind hole with a non-circular cross-section extending further into the nose from an inner bottom surface of the retainer opening;

a tip configured to be mounted on the adapter, the tip including:

a nose cavity configured to receive the nose of the adapter; and a transverse thru hole extending through a lateral side wall of the tip transverse to the longitudinal axis, the transverse thru hole being in communication with the nose cavity, the transverse thru hole including a female thread; and a retention mechanism, including:

a main retainer, including:

a retainer body extending from a retainer proximal end to a retainer distal end;

a non-circular thru hole extending along a central axis of the main retainer; and a male thread on an outer surface of the main retainer, the male thread being configured to threadedly engage the female thread in the transverse thru hole;

a center pin, including a non-circular outer profile that matches a profile of the non-circular thru hole of the main retainer; and a center pin clip attachable to the center pin, wherein the non-circular thru hole of the main retainer is configured to be aligned with the blind hole in the adapter when the main retainer is in its fully engaged position, and the center pin is configured to be inserted into the non-circular thru hole of the main retainer with a distal end of the center pin positioned in the blind hole in the adapter.

13. The tip assembly of claim 12, wherein the female thread is wrapped part way around an inner circumferential wall of the transverse thru hole.

14. The tip assembly of claim 12, wherein the male thread is wrapped part way around the outer surface of the main retainer.

15. The tip assembly of claim 12, wherein the blind hole in the retainer opening, the non-circular thru hole in the main retainer, and the center pin all have matching square profiles.

16. The tip assembly of claim 12, wherein the retainer opening extending into the nose of the adapter is one of two retainer openings extending into the nose of the adapter from opposite sides of the nose of the adapter in the direction transverse to the longitudinal axis of the adapter, and each of the retainer openings includes a blind hole with a non-circular cross-section extending further into the nose of the adapter from an inner bottom surface of the respective retainer opening.

17. The tip assembly of claim 12, wherein the transverse thru hole extending through the lateral side wall of the tip is one of two transverse thru holes extending through two opposite lateral side walls of the tip in the direction transverse to the longitudinal axis of the adapter, each of the two transverse thru holes being in communication with the nose cavity and aligned with one of the two retainer openings.

18. The tip assembly of claim 12, wherein:

the non-circular thru hole of the main retainer includes one or more indentations on an inner wall of the thru hole adjacent the retainer proximal end, and the center pin clip is disposed in a recessed portion defined around a proximal end of the center pin, with one or more protrusions on an outer surface of the center pin clip being configured to engage with the one or more indentations, thereby preventing the main retainer from being unthreaded from the tip until the center pin is removed from the main retainer.

19. A tip assembly, comprising:

a tip configured to be mounted on an adapter, the tip including:

a nose cavity configured to receive a nose of the adapter; and a transverse thru hole extending through a lateral side wall of the tip transverse to the longitudinal axis, the transverse thru hole being in communication with the nose cavity; and a retention mechanism, including:

a main retainer, including:

a retainer body extending from a retainer proximal end to a retainer distal end;

a non-circular thru hole in the retainer body extending along a central axis of the main retainer;

a detent on an inner wall of the thru hole adjacent the retainer proximal end; and a threaded outer surface of the retainer body configured to engage with a thread in the transverse thru hole;

a center pin, including a non-circular outer profile matching a profile of the non-circular thru hole of the main retainer; and a center pin clip attachable to the center pin and including a protrusion on an outer surface of the center pin clip, wherein when the main retainer is in its fully engaged position, the non-circular thru hole of the main retainer is configured to be aligned with a blind hole in the adapter, the center pin is configured to be inserted into the non-circular thru hole of the main retainer with a distal end of the center pin positioned in the blind hole in the adapter, and the protrusion on the center pin clip is configured to engage with the detent.

20. The tip assembly of claim 19, wherein the threaded outer surface of the retainer body includes a male thread wrapped part way around the outer surface, and the thread in the transverse thru hole includes a female thread wrapped part way around an inner circumferential wall of the transverse thru hole.

* * * * *